US007142219B2

(12) United States Patent
Tezuka et al.

(10) Patent No.: US 7,142,219 B2
(45) Date of Patent: Nov. 28, 2006

(54) DISPLAY METHOD AND DISPLAY APPARATUS

(75) Inventors: Tadanori Tezuka, Fukuoka-Ken (JP); Hiroyuki Yoshida, Fukuoka-Ken (JP); Bunpei Toji, Iizuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 224 days.

(21) Appl. No.: 10/108,297

(22) Filed: Mar. 26, 2002

(65) Prior Publication Data

US 2002/0135598 A1 Sep. 26, 2002

(30) Foreign Application Priority Data

Mar. 26, 2001 (JP) ..... 2001-087237

(51) Int. Cl.
*G09G 5/02* (2006.01)

(52) U.S. Cl. ..... 345/589; 345/613; 345/617; 345/591; 345/600

(58) Field of Classification Search ..... 345/589, 345/613, 617, 591, 600
See application file for complete search history.

(56) References Cited

U.S. PATENT DOCUMENTS

| | | | |
|---|---|---|---|
| 4,720,745 | A | 1/1988 | DeForest et al. |
| 4,725,828 | A | 2/1988 | Cowlishaw |
| 5,164,825 | A | 11/1992 | Kobayashi et al. |
| 5,334,996 | A | 8/1994 | Tanigaki et al. |
| 5,404,447 | A | 4/1995 | Drako et al. |
| 5,432,890 | A | 7/1995 | Watanabe |
| 5,450,208 | A | 9/1995 | Murata |
| 5,543,819 | A | 8/1996 | Farwell et al. |
| 5,623,593 | A | 4/1997 | Spells, III |
| 5,633,654 | A | 5/1997 | Kennedy et al. |
| 5,748,178 | A | 5/1998 | Drewry |
| 5,768,490 | A | 6/1998 | Hersch et al. |
| 5,821,913 | A | 10/1998 | Mamiya |
| 5,852,443 | A | 12/1998 | Kenworthy |
| 5,852,673 | A | 12/1998 | Young |
| 5,910,805 | A | 6/1999 | Hickey et al. |

(Continued)

FOREIGN PATENT DOCUMENTS

EP 0 710 925 A2 5/1996

(Continued)

OTHER PUBLICATIONS

Markhoff, John, "Microsoft's Cleartype Sets Off Debate on Originality", New York Times Online, Dec. 7, 1998, pp. 1-4.

(Continued)

*Primary Examiner*—Matthew C. Bella
*Assistant Examiner*—Tam Tran
(74) *Attorney, Agent, or Firm*—Darby & Darby

(57) ABSTRACT

When a sub-pixel of B having a small contribution to luminance emits light in isolation, a sub-pixel of R is caused to emit light or sub-pixels of B and R are caused to emit light. As a result, a sub-pixel of R having, a larger contribution to luminance than the sub-pixel of B, is caused to emit light. When an adjacent set of sub-pixels B and R having a small contribution to luminance emits light in isolation, a set of sub-pixels R and G is caused to emit light. As a result, a set of sub-pixels R and G having a higher degree of contribution to luminance than the set of sub-pixels B and R is caused to emit light. Therefore, contrast degradation from any allocation of light-emitting patterns to sub-pixels having poor luminance is eliminated and a high quality display is achieved.

20 Claims, 23 Drawing Sheets

U.S. PATENT DOCUMENTS

| | | | | |
|---|---|---|---|---|
| 6,008,820 | A | 12/1999 | Chauvin et al. | |
| 6,181,353 | B1 | 1/2001 | Kurisu | |
| 6,188,385 | B1 | 2/2001 | Hill et al. | |
| 6,219,011 | B1 * | 4/2001 | Aloni et al. | 345/1.3 |
| 6,219,025 | B1 | 4/2001 | Hill et al. | |
| 6,225,973 | B1 | 5/2001 | Hill et al. | |
| 6,236,390 | B1 | 5/2001 | Hitchcock | |
| 6,239,783 | B1 | 5/2001 | Hill et al. | |
| 6,239,789 | B1 | 5/2001 | Sekizawa et al. | |
| 6,243,055 | B1 | 6/2001 | Fergason | |
| 6,243,070 | B1 | 6/2001 | Hill et al. | |
| 6,278,434 | B1 | 8/2001 | Hill et al. | |
| 6,288,703 | B1 | 9/2001 | Berman et al. | |
| 6,299,930 | B1 | 10/2001 | Marotta et al. | |
| 6,342,896 | B1 | 1/2002 | Shetter et al. | |
| 6,356,278 | B1 | 3/2002 | Stamm et al. | |
| 6,360,023 | B1 | 3/2002 | Betrisey et al. | |
| 6,377,273 | B1 | 4/2002 | Lee et al. | |
| 6,384,839 | B1 | 5/2002 | Paul | |
| 6,396,505 | B1 | 5/2002 | Lui et al. | |
| 6,509,904 | B1 | 1/2003 | Lam | |
| 6,532,041 | B1 | 3/2003 | Monta et al. | |
| 6,542,161 | B1 | 4/2003 | Koyama et al. | |
| 6,563,502 | B1 | 5/2003 | Dowling et al. | |
| 6,608,632 | B1 | 8/2003 | Daly et al. | |
| 6,681,053 | B1 | 1/2004 | Zhu | |
| 6,750,875 | B1 | 6/2004 | Keely | |
| 6,756,992 | B1 | 6/2004 | Toji et al. | |
| 6,775,420 | B1 | 8/2004 | Daly | |

FOREIGN PATENT DOCUMENTS

| | | | |
|---|---|---|---|
| EP | 1 158 485 | A2 | 12/2001 |
| JP | 08-166778 | A1 | 6/1996 |
| JP | 2002-099239 | A1 | 4/2002 |
| WO | WO-00/21066 | A1 | 4/2000 |
| WO | WO-00/21067 | A1 | 4/2000 |
| WO | WO-00/21068 | A1 | 4/2000 |
| WO | WO-00/21070 | A1 | 4/2000 |
| WO | WO 002/21066 | | 4/2000 |
| WO | WO-00/42564 | A1 | 7/2000 |
| WO | WO-00/57305 | A1 | 9/2000 |
| WO | WO-01/09824 | A1 | 2/2001 |
| WO | WO-01/09873 | A1 | 2/2001 |

OTHER PUBLICATIONS

Printed version of http://grc.com/cleartype.htm, Sub-Pixel Font Rendering Technology, printed Mar. 22, 2002, last edit Feb. 20, 2000.

Printed version of http://grc.com/ctwhat.htm, Sub-Pixel Font Rendering Technology How it works, printed Mar. 22, 2002, last edit Feb. 11, 2002.

* cited by examiner an image for which no correcting process has been carried out an image for which a correcting process has been carried out three pixels
42
42
42 two-time magnifying
43
43
43
43
43
43 sub-pixels (light-emitting elements)
44
44
44
44
44
44
R G B R G B

Fig. 11 (a)
Fig. 11 (b)
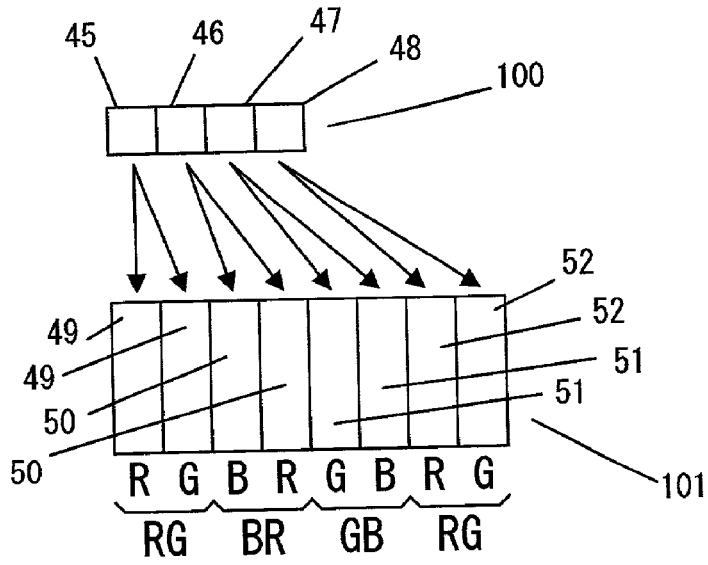
Fig. 12 (a)
Fig. 12 (b)
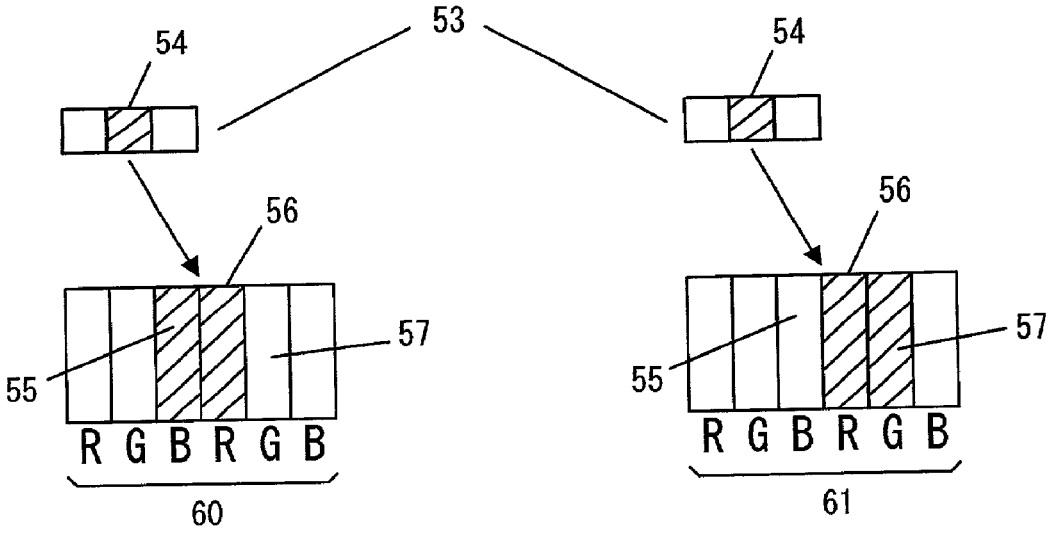

58 an image for which no correcting process has been carried out 59 an image for which a correcting process has been carried out

Fig. 22(a)

| | G | B | R | |
|---|---|---|---|---|
| multiple-value (before correction) | 100 | 200 | 90 | 102 |
| binary | OFF | ON | OFF | 103 |
| multiple-value (after correction) | 100 | 100 (→G) | 200 (→B) | 104 |

Fig. 22(b)

| | G | B | R | |
|---|---|---|---|---|
| multiple-value (before correction) | 100 | 200 | 90 | 102 |
| binary | OFF | ON | OFF | 103 |
| multiple-value (after correction) | 100 | 200 | 200 (→B) | 105 |

Fig. 22(c)

| | G | B | R | G | |
|---|---|---|---|---|---|
| multiple-value (before correction) | 100 | 200 | 150 | 90 | 106 |
| binary | OFF | ON | ON | OFF | 107 |
| multiple-value (after correction) | 100 | 100 (→G) | 200 (→B) | 150 (→R) | 108 |

Fig. 23(a)

| | G | B | R | |
|---|---|---|---|---|
| multiple-value (before correction) | 100 | 200 | 90 | 102 |
| binary | OFF | ON | OFF | 103 |
| multiple-value (after correction) | 200 (←B) | 90 (←R) | 90 | 109 |

Fig. 23(b)

| | G | B | R | |
|---|---|---|---|---|
| multiple-value (before correction) | 100 | 200 | 90 | 102 |
| binary | OFF | ON | OFF | 103 |
| multiple-value (after correction) | 200 (←B) | 200 | 90 | 110 |

Fig. 23(c)

| | G | B | R | G | |
|---|---|---|---|---|---|
| multiple-value (before correction) | 100 | 200 | 150 | 90 | 106 |
| binary | OFF | ON | ON | OFF | 107 |
| multiple-value (after correction) | 200 (←B) | 150 (←R) | 90 (←G) | 90 | 111 |

| | | | | |
|---|---|---|---|---|
| $\frac{1}{9}$ | $\frac{2}{9}$ | $\frac{3}{9}$ | $\frac{2}{9}$ | $\frac{1}{9}$ |

target sub-pixel $$V(n) = \frac{1}{9} * V_{n-2} + \frac{2}{9} * V_{n-1} + \frac{3}{9} * V_n + \frac{2}{9} * V_{n+1} + \frac{1}{9} * V_{n+2}$$

DISPLAY METHOD AND DISPLAY APPARATUS

BACKGROUND OF THE INVENTION

1. Field of the Invention

The present invention relates to a display method of a display device in which light-emitting elements of three primary colors R, G and B are aligned, and art related to this display method.

2. Description of the Related Art

Display equipment that employs various types of display devices is well known and used in the past. Included among such display devices are color LCD's, color plasma displays, and other display devices. In such display devices, three light-emitting elements, which respectively emit light of the three primary colors of R, G, and B, are aligned in a fixed order in a first direction to form one pixel. A plurality of such pixels is aligned in the first direction to form one line. A plurality of such lines is aligned in a second direction, which is orthogonal to the first direction, to form the display screen.

There are also many display devices, such as a display device in a portable telephone, mobile computer, etc., which have a relatively narrow display screen and in which detailed display is difficult to achieve. When the display of a small character, photograph, or complex picture, etc. is attempted with such a display device, part of the image tends to become smeared and unclear.

Literature (titled: "Sub Pixel Font Rendering Technology") concerning sub-pixel displays, which makes use of each pixel being formed of the three light-emitting elements for R, G, and B to improve the clarity of the display on a narrow screen, is disclosed on the Internet. The present inventors have checked this literature upon downloading it from the site, http://grc.com, or its subordinate.

This art is described with reference to FIGS. 24 to 29. In the following description, the image of the alphabetic character, "A", is used as an example of the image to be displayed.

Referring to FIG. 24, each single line is composed of a plurality of pixels, each of which is formed from three light-emitting elements aligned along the direction of the line. The horizontal direction in FIG. 24 (the direction in which the light-emitting elements of the three primary colors of R, G, and B are aligned) is referred to as the first direction. The orthogonal, vertical, direction is referred to as the second direction. Any order of alignment of the light-emitting elements besides R, G, and B is possible. The prior art and the present invention are applied likewise even if the order of alignment is changed.

A pixel (set of three light-emitting elements) is aligned in a single row in the first direction. A plurality of pixels are aligned in the first direction to arrange a single line. A plurality of lines is aligned in the second direction to arrange the display screen.

With this sub-pixel technology, the original image is, for example, an image such as shown in FIG. 25. In this example, the character, "A", is displayed over an area of seven pixels each in the horizontal and vertical directions. Where each of the R, G, and B light-emitting elements is handled as a single pixel in order to perform sub-pixel display, a font, which has a definition of three times that of the above-described image in the horizontal direction, is prepared, as shown in FIG. 26, over an area of 21 (=7×3) pixels in the horizontal direction and 7 pixels in the vertical direction.

Then as shown in FIG. 27, a color is determined for each of the pixels in FIG. 25 (i.e., note that this is not the individual sub-pixel elements of FIG. 26 but the three-element pixels of FIG. 25). However, since color irregularities occur if the image is displayed as it is, a filtering process, using factors such as shown in FIG. 28(*a*), is applied. Factors concerning the luminance are shown in FIG. 28(*a*). The luminance values of the respective sub-pixels are adjusted, or weighted, by multiplying by a factor of, for example, of 3/9 in the case of the central target sub-pixel, of 2/9 in the case of an adjacent sub-pixel, and of 1/9 in the case of the sub-pixel next to the adjacent sub-pixel.

These factors are now described in more detail with reference to FIG. 29. In FIG. 29, the "*" indicates that the sub-pixel may be any of the three primary color light-emitting elements for R, G, and B. The determination of the factors is started from the first stage at the top and proceeds downward to the second stage and the third stage. The factor of the central target sub-pixel is determined at the center of the third stage.

In proceeding from the first stage to the second stage, energy is collected uniformly among the three primary color light-emitting elements for R, G, and B. That is, the factor of the first stage is just 1/3. Likewise, energy is collected uniformly in proceeding from the second stage to the third stage, that is, the factor of the second stage is also just 1/3.

Since the central sub-pixel is reached from the first stage along a total of three paths at the center, left, and right sides of the second stage, the synthetic factor (in which the factors of the first and second stages are synthesized) of the central sub-pixel is $1/3\times1/3+1/3\times1/3+1/3\times1/3=3/9$. Also, since a sub-pixel adjacent the central pixel is reached via two paths, the synthetic factor thereof is $1/3\times1/3+1/3\times1/3=2/9$. Since there is only one path for a next adjacent sub-pixel, the synthetic factor thereof is $1/3\times1/3=1/9$.

OBJECTS AND SUMMARY OF THE INVENTION

However, when detailed expression is carried out utilizing such sub-pixels, for example, if there is a part where only isolated Blue (B) is emitted when an original image is allocated to sub-pixels, the contrast of the part is lowered since the luminance of Blue (B) is lower than that of the other light-emitting elements, and the problem arises that the blue part is so dim that it is difficult to see.

Therefore, it is an object of the invention to provide a display method and a display apparatus that are able to overcome the lowering of contrast due to allocation of light-emitting patterns to sub-pixels and that is able to achieve a high quality display.

A first aspect of this invention provides in a method of performing display with a display device, in which three light-emitting elements, which respectively emit light of the three primary colors of R, G, and B, are aligned in a fixed order to form one pixel. A plurality of such pixels are aligned in the first direction to form one line. A plurality of such lines are aligned in a second direction, that is orthogonal to the first direction, to form a display screen. The method comprises the steps of: correcting a light-emitting pattern so that the contrast becomes high where sub-pixel data having a light-emitting pattern defined in advance exist in sub-pixel data obtained from data of an image to be displayed; and allocating sub-pixel data to the light-emitting elements corresponding thereto after the correcting step and performing display with the display device.

A display apparatus of a second aspect of this invention is equipped with a display device, in which three light-emitting elements, which respectively emit light of the three primary colors of R, G, and B, are aligned in a fixed order to form one pixel. A plurality of the pixels are aligned in a first direction to form one line, and a plurality of such lines are aligned in a second direction, which is orthogonal to the first direction, to form the display screen. A correcting unit, which corrects a light-emitting pattern so that the contrast becomes high where sub-pixel data having a light-emitting pattern defined in advance exist in sub-pixel data obtained from data of an image to be displayed, and a display control unit which allocates sub-pixel data to the light-emitting elements corresponding thereto after the correction by the correcting unit and makes the display device perform display.

With the above-described construction, in the display method according to the first aspect of this invention and the display apparatus according to the second aspect thereof, a light-emitting pattern is corrected by setting a pattern for lowering the contrast as a light-emitting pattern defined in advance, so that the contrast becomes high if sub-pixel data having the light-emitting pattern exist.

As a result, it is possible to prevent the contrast from being lowered due to allocation of light-emitting patterns to sub-pixels and makes it possible to achieve a high quality display.

A third aspect of this invention provides a method for performing display with a display device, in which three light-emitting elements, which respectively emit light of the three primary colors of R, G, and B, are aligned in a fixed order to form one pixel. A plurality of such pixels are aligned in the first direction to form one line, and a plurality of such lines are aligned in a second direction, that is orthogonal to the first direction, to form a display screen. The method comprises the steps of: magnifying data of an image to be displayed by a factor of two in the first direction to generate sub-pixel data; and allocating sub-pixel data to the light-emitting elements corresponding thereto and performing display with the display device.

A display apparatus of a fourth aspect of this invention is equipped with a display device, in which three light-emitting elements, which respectively emit light of the three primary colors of R, G, and B, are aligned in a fixed order to form one pixel. A plurality of the pixels are aligned in a first direction to form one line, and a plurality of such lines are aligned in a second direction, which is orthogonal to the first direction, to form the display screen, a two-times magnifying unit, which magnifies data of an image to be displayed, by a factor of two in the first direction to generate sub-pixel data, and a display control unit, which allocates the sub-pixel data to light-emitting elements corresponding thereto and makes the display device perform display.

With the above-described construction, in the display method according to the third aspect of this invention and the display apparatus according to the fourth aspect thereof, it is possible to obtain an image reduced to two-thirds (⅔) in comparison with its original image. As a result, it is possible to increase the number of characters that are displayed in a display device of the same size.

Also, when original data of one pixel are displayed on the display device, the data are allocated to two light-emitting elements (sub-pixels). As a result, no light-emitting pattern whose contrast is remarkably low is generated.

A fifth aspect of this invention provides in a method of performing display with a display device, with which three light-emitting elements, which respectively emit light of the three primary colors of R, G, and B, are aligned in a fixed order to form one pixel, such pixels are aligned in the first direction to form one line, and a plurality of such lines are aligned in a second direction, that is orthogonal to the first direction, to form a display screen; the method comprises a first step of searching data of an image having a pattern in which only one pixel positioned at the center emits light, from three pixels adjacent to each other in the first direction among image data to be displayed; a step of generating sub-pixel data by magnifying the data of an image to be displayed, by a factor of two in the first direction; a second step of searching sub-pixel data having a light-emitting pattern defined in advance from the sub-pixel data corresponding to the data of the image where data of an image having the pattern, in which only one pixel positioned at the center emits light, exist according to the result of the first searching step; a step of correcting the light-emitting pattern so that the contrast becomes high where the sub-pixel data having the light-emitting pattern defined in advance, exist according to the result of the second searching step; and a step of allocating the sub-pixel data to the light-emitting elements corresponding thereto after the correcting step and performing display with the display device.

A display apparatus of a sixth aspect of this invention is equipped with a display device, in which three light-emitting elements, which respectively emit light of the three primary colors of R, G, and B, are aligned in a fixed order to form one pixel, a plurality of the pixels are aligned in a first direction to form one line, and a plurality of such lines are aligned in a second direction, which is orthogonal to the first direction, to form the display screen, a two-times magnifying unit, which searches data of an image having a pattern, in which only one pixel positioned at the center emits light, from three pixels adjacent to each other in the first direction among image data to be displayed, and generates sub-pixel data by magnifying the image data to be displayed, by a factor of two in the first direction, a correcting unit, which searches sub-pixel data having a light-emitting pattern defined in advance, from the sub-pixel data corresponding to the image data where image data having the pattern, in which only one pixel positioned at the center emits light, exists according to the result of a search by the two-times magnifying unit, and corrects the light-emitting pattern, so that the contrast becomes high, where sub-pixel data having the light-emitting pattern defined in advance exist according to the result of a search, and a display control unit, which allocates the sub-pixel data to the light-emitting elements corresponding thereto after the correction by the correcting unit and makes the display device perform display.

With the above-described construction, in the display method according to the fifth aspect of this invention and the display apparatus according to the sixth aspect thereof, the light-emitting pattern is corrected by setting a pattern, by which the contrast is lowered, as the light-emitting pattern defined in advance, so that the contrast becomes high where sub-pixel data having the light-emitting pattern exist.

As a result, since it is possible to prevent the contrast from being lowered due to any allocation of the light-emitting pattern to the sub-pixels, a high-quality display is achieved.

Further, since the sub-pixel data having the light-emitting pattern defined in advance is searched from sub-pixel data obtained from image data having the pattern in which only one pixel emits light in isolation, it is not necessary to search the light-emitting pattern defined in advance from all of the obtained sub-pixel data. As a result, the time required for searching the light-emitting pattern defined in advance is shortened.

A seventh aspect of this invention provides in a method of performing display with a display device, with which three light-emitting elements, which respectively emit light of the three primary colors of R, G, and B, are aligned in a fixed order to form one pixel, a plurality of such pixels are aligned in a first direction to form one line, and a plurality of such lines are aligned in a second direction, that is orthogonal to the first direction, to form a display screen; the method comprises the steps of: generating binary sub-pixel data by determining a state of emitting light or a state of not emitting light on the basis of a threshold value defined in advance, with respect to sub-pixel data of multiple values, which are obtained from multiple-value image data to be displayed; searching binary sub-pixel data having a light-emitting pattern defined in advance from the binary sub-pixel data; correcting a light-emitting pattern of the multiple-value sub-pixel data corresponding to the searched binary sub-pixel data so that the contrast becomes high where binary sub-pixel data having the light-emitting pattern defined in advance are searched in the searching step; and allocating multiple-value sub-pixel data to light-emitting elements corresponding thereto after the correcting step, and performing display with the display device.

A display apparatus of an eighth aspect of this invention is equipped with a display device, in which three light-emitting elements, which respectively emit light of the three primary colors of R, G, and B, are aligned in a fixed order to form one pixel, a plurality of the pixels are aligned in a first direction to form one line, and a plurality of such lines are aligned in a second direction, which is orthogonal to the first direction, to form the display screen, a binary data generating unit, which generates binary sub-pixel data by determining a state of emitting light or a state of not emitting light on the basis of a threshold value defined in advance, with respect to sub-pixel data of multiple values, which are obtained from multiple-value image data to be displayed, a correcting unit, which searches binary sub-pixel data having a light-emitting pattern defined in advance from the binary sub-pixel data and corrects a light-emitting pattern of the multiple-value sub-pixel data corresponding to the searched binary sub-pixel data so that the contrast becomes high, and a display control unit, which allocates multiple-value sub-pixel data to light-emitting elements corresponding thereto after the correcting step, and makes the display device perform display.

With the above-described construction, in the display method according to the seventh aspect of this invention and the display apparatus according to the eighth aspect thereof, where binary sub-pixel data having the light-emitting pattern defined in advance exist, the light-emitting pattern of the multiple-value sub-pixel data corresponding thereto is corrected, by setting a pattern for lowering the contrast as the light-emitting pattern defined in advance, so that the contrast becomes high.

As a result, it is possible to prevent the contrast from being lowered due to any allocation of the light-emitting patterns to the sub-pixel data, and a high-quality multiple-value image is displayed.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 3(*b*) is a view to which reference will be made in describing a second part of a process for generating sub-pixel data in the first embodiment of the invention.

FIG. 3(*c*) is a view to which reference will be made in describing a third part of a process for generating sub-pixel data in the first embodiment of the invention.

FIG. 4(*b*) is a view to which reference will be made in describing the rules of a correcting process in the first embodiment of the invention.

FIG. 4(*c*) is a view to which reference will be made in describing the rules of a correcting process in the first embodiment of the invention.

FIG. 5(*b*) is a plan view showing sub-pixel data after the correcting process in the first embodiment of the invention.

FIG. 6(*b*) is an image view where a correcting process according to the first embodiment of the invention is carried out.

FIG. 10(*b*) is a view to which reference will be made in describing a sub-pixel data generating process according to the second embodiment of the invention.

FIG. 10(*c*) is a view to which reference will be made in describing a sub-pixel data generating process according to the second embodiment of the invention.

FIG. 11(*a*) is a view to which reference will be made in describing the degree of contribution of sub-pixel data to luminance.

FIG. 11(*b*) is a view to which reference will be made in describing the degree of contribution of sub-pixel data to luminance.

FIG. 12(*a*) is a view to which reference will be made in describing the rules of a correcting process in the second embodiment of the invention.

FIG. 12(*b*) is a view to which reference will be made in describing the rules of a correcting process in the second embodiment of the invention.

FIG. 13(*b*) is an image view where a correcting process is carried out in the second embodiment of the invention.

FIG. 21(*b*) is a view exemplifying multiple-value sub-pixel data that are generated by a sub-pixel data generating unit according to the third embodiment of the invention.

FIG. 21(*c*) is a view exemplifying binary sub-pixel data that are generated by a binary data generating unit according to the third embodiment of the invention.

FIG. 22(*a*) is a view to which reference will be made in describing rules of a correcting process according to the third embodiment of the invention.

FIG. 22(*b*) is a view to which reference will be made in describing rules of a correcting process according to the third embodiment of the invention.

FIG. 22(*c*) is a view to which reference will be made in describing rules of a correcting process according to the third embodiment of the invention.

FIG. 23(*a*) is a view to which reference will be made in describing another example of the rules of a correcting process according to the third embodiment of the invention.

FIG. 23(*b*) is a view to which reference will be made in describing still another example of the rules of a correcting process according to the third embodiment of the invention.

FIG. 23(*c*) is a view to which reference will be made in describing still another example of the rules of a correcting process according to the third embodiment of the invention.

FIG. 28(*b*) is a view exemplifying the results of a filtering process according to the prior art.

DETAILED DESCRIPTION OF THE PREFERRED EMBODIMENTS

[Embodiment 1]

Figure 1:
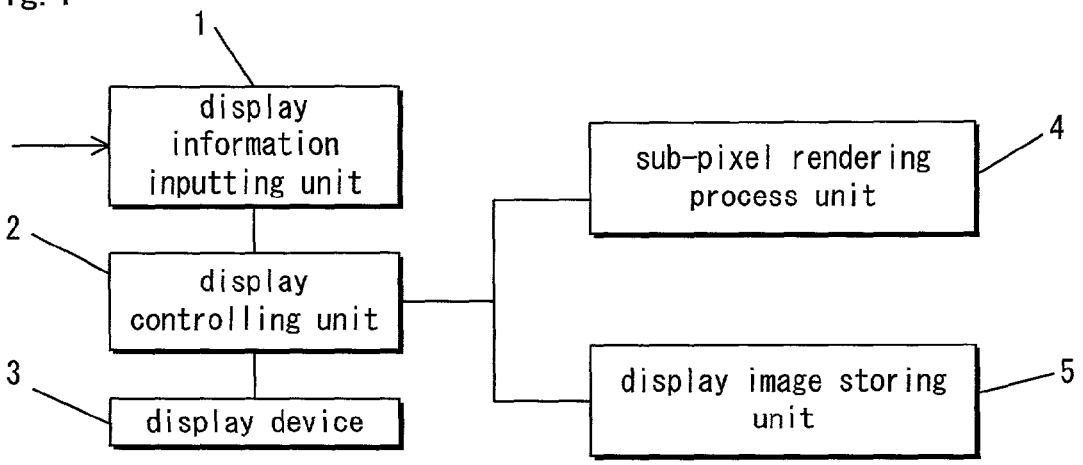
FIG. 1 is a block diagram of a display apparatus according to a first embodiment of the present invention.

Referring to FIG. 1, a display apparatus according to a first embodiment of the present invention includes a display information inputting unit 1, display controlling unit 2, a display device 3, sub-pixel rendering process unit 4, and display image storing unit 5.

The display information inputting unit 1 inputs display information, consisting of binary image data.

The display controlling unit 2 controls the display device 3 to perform display on the basis of display data stored in the display image storing unit 5 (VRAM, etc.) for displaying sub-pixels.

The display device 3 employs sets of three light-emitting elements, which respectively emit light of the three primary colors of R, G, and B. The three light-emitting elements of a set are aligned in a fixed order to form one pixel. A plurality of pixels thus formed is aligned in a first direction to form one line. A plurality of such lines is aligned in a second direction, which is orthogonal to the first direction, to form the display screen. To be more specific, the display device 3 may be a color LCD (Liquid Crystal Display), a color plasma display, or an organic EL (Electro luminescent) display, etc. Although not shown in the figure, the display device 3 includes a conventional driver for driving the respective elements of the color LCD, the color plasma display, or the organic EL display etc.

The sub-pixel rendering process unit 4 generates sub-pixel data on the basis of display information inputted through the display information inputting unit 1, and carries out a correcting process and a filtering process.

Figure 2:
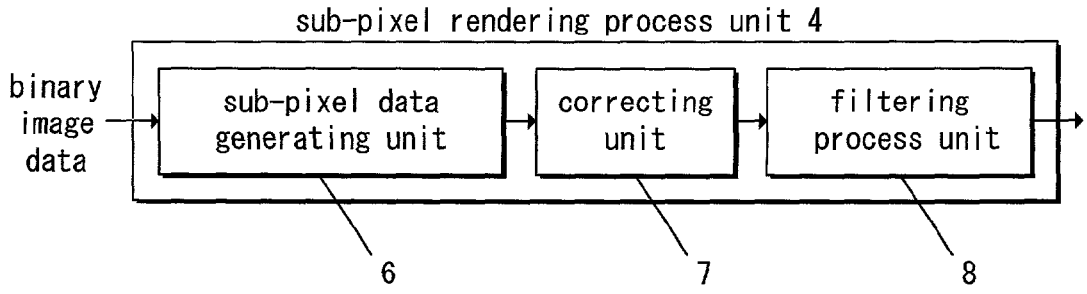
FIG. 2 is a block diagram showing a sub-pixel rendering process unit in the first embodiment of the invention.

Referring now to FIG. 2, the sub-pixel rendering process unit 4 includes sub-pixel data generating unit 6, correcting unit 7 and filtering process unit 8.

Hereinafter, where it is assumed that display information that is inputted by the display information inputting unit 1 is binary image data, a description is given of actions taking place in the respective components.

The sub-pixel data generating unit 6 generates sub-pixel data on the basis of the inputted binary image data. For example, where an image, having the same magnification as that of the inputted binary image, is displayed on the display device 3, the inputted binary image data are magnified by a factor of three in the first direction to generate sub-pixel data. This point is described in further detail.

Figures 3A, 3B, 3C:
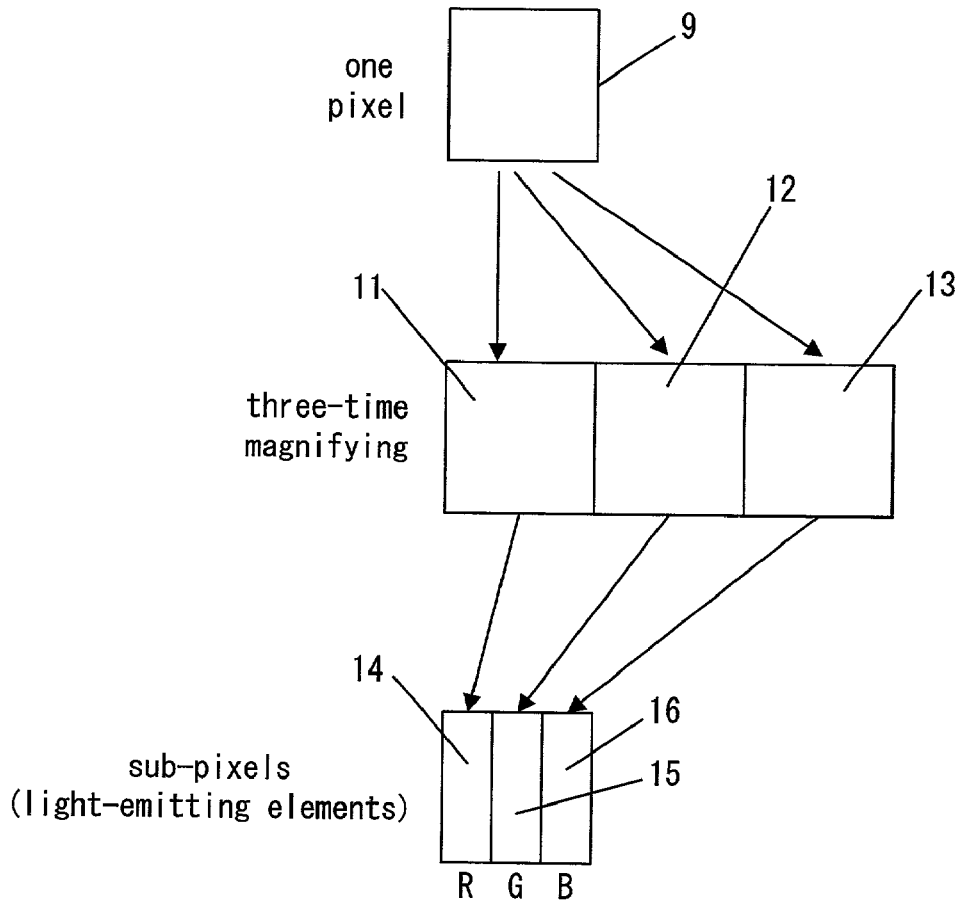
FIG. 3(*a*) is a view to which reference will be made in describing a first part of a process for generating sub-pixel data in the first embodiment of the invention.

Referring now to FIGS. 3(*a*)–3(*c*), a process for generating sub-pixel data in the first embodiment of the invention takes into account a case, as one example, of the display of an image on the display device 3 that is of the same magnification as the inputted binary. Only one pixel of the inputted binary image data is noted for convenience of explanation.

The sub-pixel data generating unit 6 magnifies data 9 (FIG. 3(*a*)) of the inputted one pixel by a factor of three in the first direction to obtain sub-pixel data 11, 12 and 13 (FIG. 3(*b*)). The three sub-pixel data 11, 12 and 13 are allocated to three sub-pixels (light-emitting elements) 14, 15 and 16 of R, G and B (FIG. 3(*c*)).

Therefore, as has been made clear through a comparison between FIG. 3(*a*) and FIG. 3(*c*), an image is obtained that has the same magnification as the inputted binary image.

Herein, a "sub-pixel" indicates each of the elements that are obtained by dividing one pixel into three equal divisions in the first direction. Therefore, since one pixel is constituted of three aligned light-emitting elements, which emit three primary colors of R, G and B, in a fixed sequence, three sub-pixels of R, G and B correspond to three light-emitting elements of R, G and B.

Where an image that is obtained by reducing the inputted binary image by one-second is acquired, as another example, the sub-pixel data generating unit 6 magnifies the inputted binary image data by three-seconds in the first direction and is reduced by one-second in the second direction.

Generally, where an image that is magnified or reduced by "A" times in the first direction with respect to the inputted binary image is displayed on the display device 3, the inputted binary image data must be magnified or reduced by a factor of "C" in the first direction. However, 3×A=C.

Also, where an image that is magnified or reduced by "D" times in the second direction with respect to the inputted binary image is displayed on the display device 3, the inputted binary image data must be magnified or reduced by a factor of "E" in the second direction. However, D=E.

As described above, the sub-pixel data generating unit 6 generates sub-pixel data suited to a display size in the display device 3 on the basis of the inputted binary image data. In the above description, an example in which the display size of the display device 3 is converted to the same magnification as the inputted binary image or one-second reduction thereof is employed. However, the magnification is not limited to the above, but may be optionally set. Magnification of binary image data to generate sub-pixel data is determined in response to the above-described magnification.

Where binary image data has been already processed to sub-pixel data, no process in the sub-pixel data generating unit 6 is carried out, and the binary image data are directly inputted into the correcting unit 7.

Next, a brief description is given of actions of the correcting unit 7.

First, the correcting unit 7 searches sub-pixels having a specified light-emitting pattern. Next, the correcting unit 7 corrects for the light-emitting pattern so that contrast becomes high.

Figure 4A:
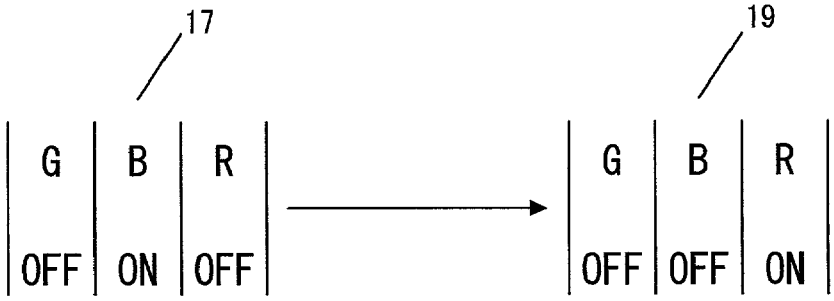
FIG. 4(*a*) is a view to which reference will be made in describing the rules of a correcting process in the first embodiment of the invention.
Figure 4B:
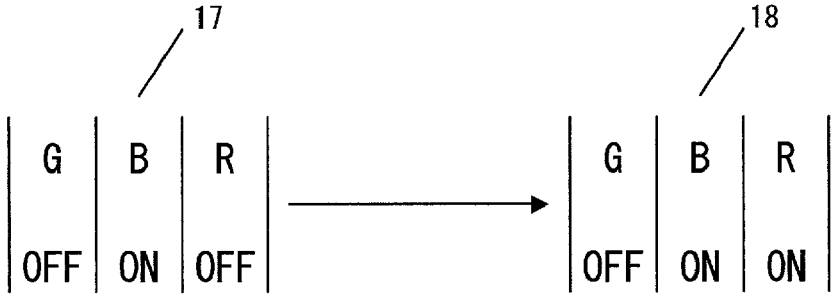
Figure 4C:
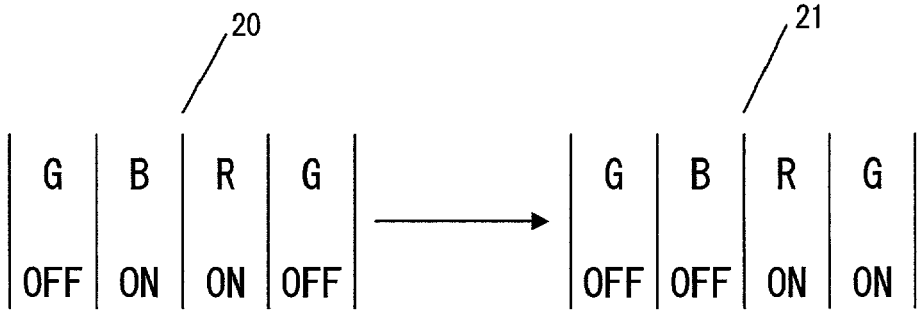

Next, a detailed description is given of actions of the correcting unit 7. Referring now to FIGS. 4(*a*)–4(*c*), the states are shown where sub-pixel data are allocated to sub-pixels, and are used to explain the rules of a correcting process in the correcting unit 7 in FIG. 2.

Since image data that are inputted into the sub-pixel data generating unit 6 are binary image data, for simplification in FIGS. 4(*a*)–4(*c*), sub-pixel data are expressed to be ON where a sub-pixel (light-emitting element) is energized to emit light, and sub-pixel data are expressed to be OFF where a sub-pixel (light-emitting element) is not energized to emit light. A row of sub-pixels (light-emitting elements) in the display device 3 is the sequence of R, G and B.

In the following description, colors of sub-pixels (light-emitting elements) and light-emitting states are expressed to be R (ON), R (OFF), G (ON), G (OFF), B (ON), and B (OFF) in combinations.

As shown in FIG. 4(*a*), the correcting unit 7 searches sub-pixel data 17, having a specified light-emitting pattern (a light-emitting pattern defined in advance) where Blue (B) emits light in isolation, which are G (OFF), B (ON) and R (OFF) as a row of sub-pixels.

The correcting unit 7 corrects the sub-pixel data 17 so that the sub-pixel of B is turned [OFF] and the sub-pixel of R is turned [ON], thereby causing a row of the sub-pixels to be converted to sub-pixel data 19 of G (OFF), B (OFF), and R (ON).

Alternatively, the correcting unit 7 corrects the searched sub-pixel data 17, as shown in FIG. 4(*b*), so that sub-pixels of B and R are turned [ON], and a row of the sub-pixels is converted to G (OFF), B (ON), and R (ON).

As another alternative, on one hand, as shown in FIG. 4(*c*), the correcting unit 7 searches sub-pixel data 20, having a specified light-emitting pattern (a light-emitting pattern defined in advance) in which a set of B (Blue) and R (red) sub-pixels emit light in isolation, where a row of the sub-pixels is G (OFF), B (ON), R (ON) and G (OFF). The correcting unit 7 corrects the sub-pixel data 20 so that the sub-pixel of B is turned [OFF] and the sub-pixels of R and G are turned [ON], whereby sub-pixel data 21 are obtained, in which a row of the sub-pixels is G (OFF), B (OFF), R (ON), and G (ON).

As described above, the reasons why a pattern, in which B emits light in isolation, is set as a specified light-emitting pattern that is searched by the correcting unit 7 are as follows.

Generally, it is said that the contribution to the degree of luminance of R, G and B is R:G:B=3:6:1. Therefore, when only the B sub-pixel emits light in isolation, the B sub-pixel generates only one-third the brightness in comparison with a case where only R emits light in isolation, and one-sixth the brightness in comparison with a case where only G emits light in isolation.

That is, luminance in an area of the display in which only B emits light in isolation becomes low, and the contrast in that area is lowered. Accordingly, if the light-emitting pattern of G(OFF), B(ON) and R(OFF) exists, the contrast must be improved by correcting the light-emitting pattern.

Therefore, if a light-emitting pattern of G(OFF), B(OFF), and R(ON) (sub-pixel data 19 in FIG. 4(*a*)) or a light-emitting pattern of G(OFF), B(ON) and R(ON) (sub-pixel data 18 in FIG. 4(*b*)) exists, by correcting the light-emitting pattern of G(OFF), B(ON) and R(OFF) (sub-pixel data 17 in FIGS. 4(*a*) and (*b*)), it is possible to obtain luminance which is greater by a factor of three or four, whereby the contrast is remarkably improved.

This improvement is for the same reason that a pattern in which a set of B and R emits light in isolation is set as the light-emitting pattern that is searched by the correcting unit 7.

Therefore, if a light-emitting pattern (sub-pixel data 21 in FIG. 4(*c*)) of G(OFF), B(OFF), R(ON), and G(ON) is employed by correcting the light-emitting pattern (sub-pixel data 20) of G(OFF), B(ON), R(ON) and G(OFF), it is possible to obtain luminance that is greater by nine-fourths (9/4), whereby the contrast is improved.

Also, in addition to the corrections shown in FIGS. 4(*a*) and (*b*), the light-emitting pattern of G(OFF), B(ON), R(OFF) is corrected to be G(ON), B(OFF), and R(OFF) or G(ON), B(ON), and R(OFF). In this case, effects that are the same as in the above are achieved.

In addition to the correction shown in FIG. 4(*c*), the light-emitting pattern of G(OFF), B(ON), R(ON) and G(OFF) is corrected to be G(ON), B(ON), R(OFF) and G(OFF). In this case, the same contrast improvement is achieved as in the above.

As described above, in the present embodiment, taking note of the sub-pixels of B that has the lowest degree of contribution to the luminance of the three primary colors of R, G and B, when the sub-pixel of B or a set of sub-pixels of B and R emits light in isolation, contrast is improved by energizing the sub-pixel of R or G, which further greatly contributes to luminance than the sub-pixel of B, to emit light.

Although a correcting process is carried out with respect to rows (light-emitting pattern) of sub-pixels shown in FIG. 4, an effect which is almost the same effect as in the above is achieved by carrying out a correcting process in rows (light-emitting pattern) of other sub-pixels in order to strengthen the contrast.

A detailed description is given of a correcting process in the correcting unit 7.

Figure 5A:
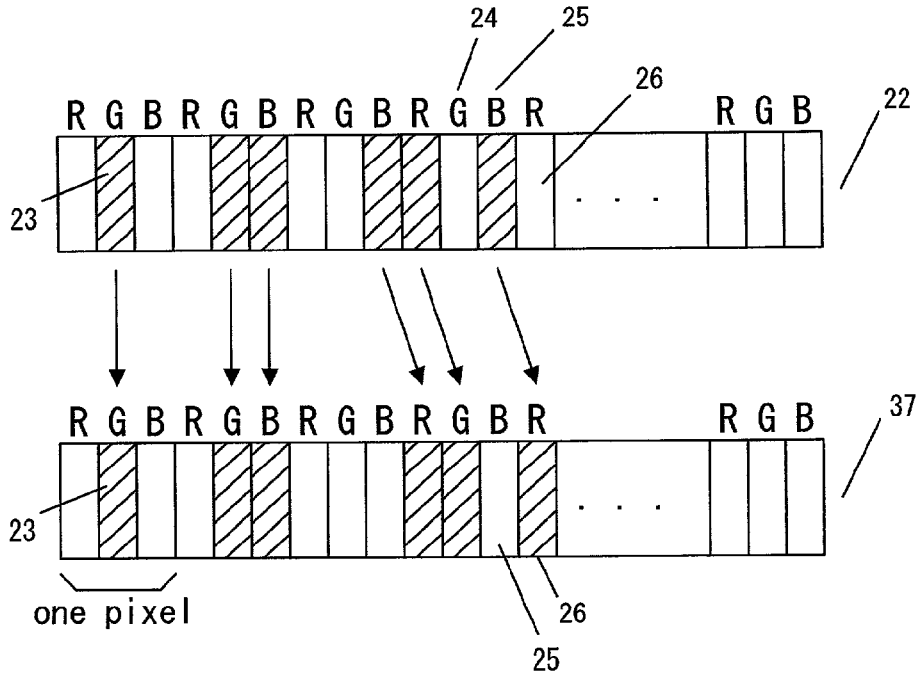
FIG. 5(*a*) is a plan view showing sub-pixel data before the correcting process in the first embodiment of the invention.

Referring now to FIGS. 5(*a*)–5(*b*), FIG. 5(*a*) shows one line in the first direction of sub-pixel data 22 before the correcting process, and FIG. 5(*b*) shows one line in the first direction of sub-pixel data 37 after the correcting process.

Also, in FIGS. 5(*a*)–5(*b*), a state is shown, where sub-pixel data are allocated to sub-pixels for convenience of description. In the same drawing, sections shown with diagonal lines identifying sub-pixels which are energized to emit light.

Further, in FIGS. 5(*a*)–5(*b*), a specified light-emitting pattern shown in FIGS. 4(*a*)–4(*c*) is employed as the specified light-emitting pattern for which the correcting unit 7 searches. Correction is subject to the rules shown in FIGS. 4(*a*)–4(*c*).

The correcting unit 7 searches for sub-pixel data having the specified light-emitting pattern. For example, as shown in FIG. 5(*a*), a sub-pixel 23 of G(ON) is not a specified light-emitting pattern. Therefore, the sub-pixel 23 of G(ON) will be turned [ON] (is caused to emit light) as it is, in a sub-pixel 37 after the correction, as shown in FIG. 5(*b*). Where the correcting unit 7 detects sub-pixel data having a specified light-emitting pattern in which a row of sub-pixels becomes a sub-pixel 24 of G(OFF), a sub-pixel 25 of B(ON), and a sub-pixel 26 of R(OFF) as shown in FIG. 5(*a*), the light-emitting pattern is corrected so that the contrast is improved.

That is, in this case, as shown in FIG. 5(*b*), the correction is made so that the sub-pixel 25 of B(ON) is turned [OFF] and the sub-pixel 26 of R(OFF) is turned [ON].

Figure 6A:
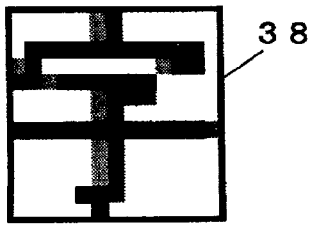
FIG. 6(*a*) is an image view where no correcting process according to the first embodiment of the invention is carried out.
Figure 6B:
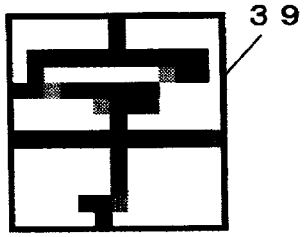

Referring now to FIGS. 6(*a*)–6(*b*), a comparison is shown of a case in which no correcting process is carried out and a case in which the correcting process is carried out.

In FIG. 6(*a*), an image 38, in which no correcting process has been performed is compared with an image 39 in FIG. 6(*b*) in which the correcting process has been performed. The image 39, on which the correcting process has been carried out, exhibits a large improvement in brightness. In particular, the sections containing vertical lines become darker than in the case where no correcting process has been carried out. As a result, it is found that the contrast with respect to the background (white) has been improved.

Thus, through a correcting process, it is possible to improve the contrast especially with respect to fine lines, whereby display is made more easily visible.

Based on the above description, next, a description is given of a process flow of a display apparatus according to the first embodiment of the present invention with reference to the accompanying drawings.

Figure 7:
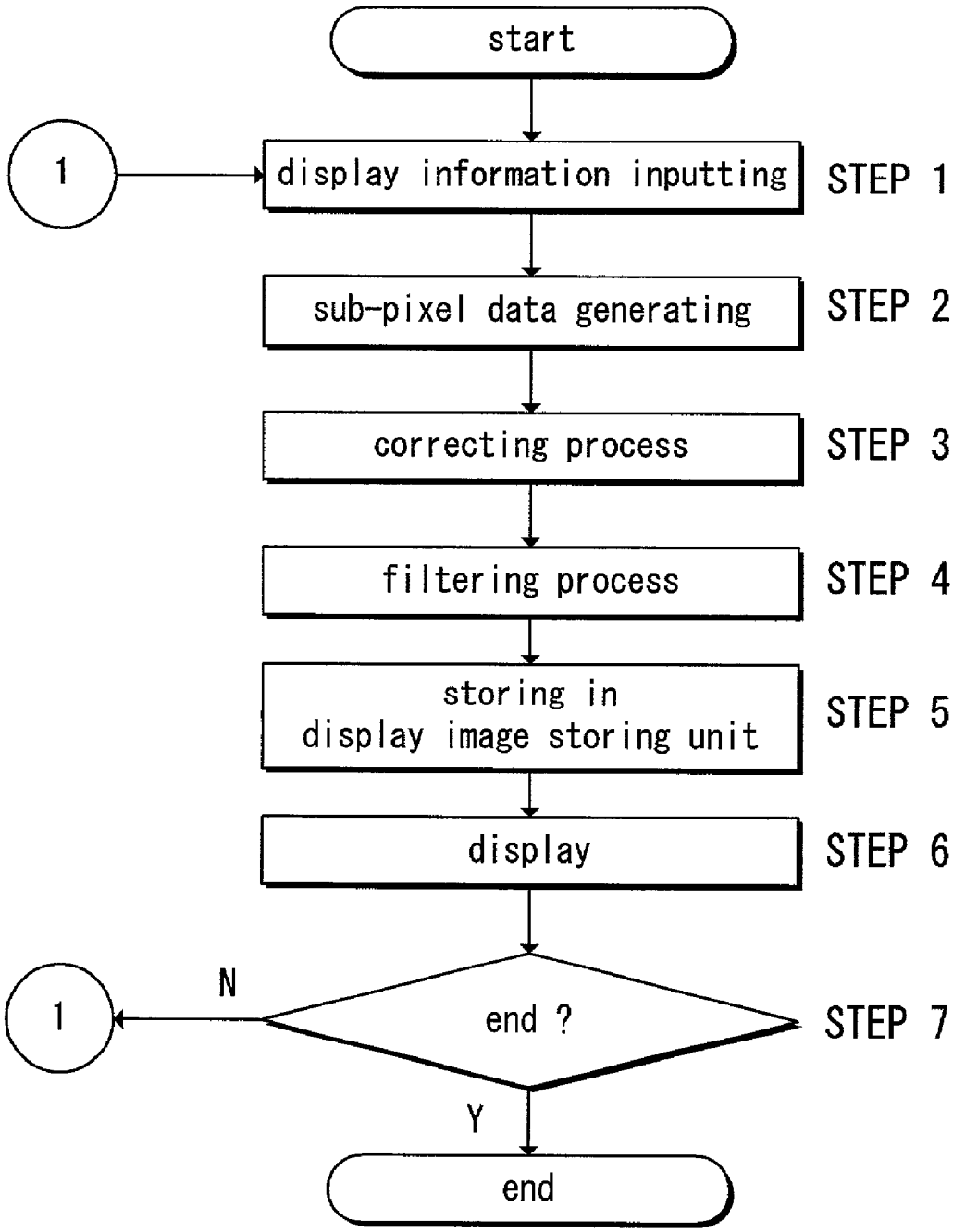
FIG. 7 is a flow chart of a display apparatus according to the first embodiment of the invention.

Referring now to the flow chart in FIG. 7, together with the block diagrams in FIGS. 1 and 2, a display apparatus according to the first embodiment of the invention, performs the following process: first, in STEP 1, display information is inputted to display information inputting unit 1. As described above, the display information to be inputted is binary image data.

Next, in STEP 2, the binary image data are applied to sub-pixel data generating unit 6, in which sub-pixel data are generated.

Next, in STEP 3, the correcting unit 7 carries out a correcting process with respect to sub-pixel data that are inputted from the sub-pixel data generating unit 6. Herein, a specified light-emitting pattern in which only B emits light in isolation, and a specified light-emitting pattern in which a set of B and R emits light in isolation are searched, and are subjected to correction.

Next, in STEP 4, filtering process unit 8 carries out a filtering process for sub-pixel data that are inputted from and corrected by the correcting unit 7.

The filtering process is carried out with respect to the result of the correcting process in STEP 3 in order to suppress color irregularities. For example, a filtering process, which is described in FIG. 24 through FIG. 29, that is, a filtering process that is disclosed in Literature (Title: "Sub Pixel Font Rendering Technology" (http://grc.com) regarding a sub-pixel display may be utilized as the above-described filtering process.

Next, in STEP 5, the filtering process unit 8 returns the post-process sub-pixel data to the display controlling unit 2, and the display controlling unit 2 stores the received sub-pixel data in the display image storing unit 5.

Next, in STEP 6, the display controlling unit 2 allocates the sub-pixel data, which are stored in the display image storing unit 5, to three light-emitting elements, constituting one pixel, of a display device 3, and makes the display device 3 perform display.

Unless display is terminated (STEP 7), the display controlling unit 2 returns the process to STEP 1.

Next, a description is given of a flow of a correcting process in STEP 3 in FIG. 7.

Figure 8:
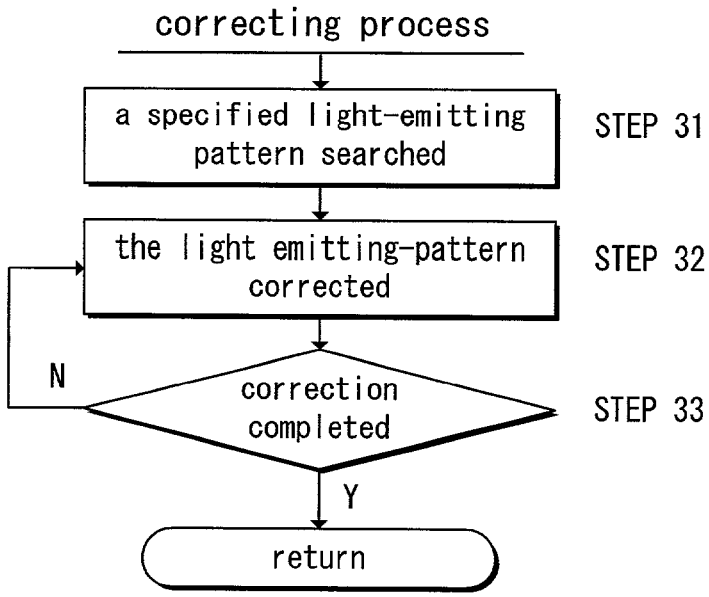
FIG. 8 is a flow chart of a correcting process in the first embodiment of the invention.

Referring now also to the flow chart in FIG. 8, the correcting process in STEP 3 in FIG. 7 begins in STEP 31, where the correcting unit 7 searches sub-pixel data having a specified light-emitting pattern.

Next, in STEP 32, the correcting unit 7 corrects the light-emitting pattern to increase the contrast. When correction is completed with respect to all sub-pixel data having the specified light-emitting pattern searched in Step 31, the process shifts to STEP 4 in FIG. 7 (STEP 33).

As described above, in the display apparatus according to the present embodiment, where sub-pixel data having a specified light-emitting pattern exist in the sub-pixel data obtained from the inputted binary image data, the correcting unit 7 corrects the light-emitting pattern to increase the contrast.

When sub-pixel data having a specified light-emitting pattern exist if a pattern for lowering the contrast is established as the specified light-emitting pattern, the light-emitting pattern is corrected to improve the contrast.

As a result, the contrast is prevented from being lowered due to the allocation of the light-emitting pattern to the sub-pixels, whereby a high-quality binary image display is achieved.

In further detail, a specified light-emitting pattern (sub-pixel data 17 in FIGS. 4(*a*) and 4(*b*)), which is searched by the correcting unit 7 is a pattern in which the sub-pixel of B among three primary colors of R, G and B emits light in isolation. In this case, the correcting unit 7 corrects to a pattern in which any one of sub-pixels adjacent to both sides of the sub-pixel of B that emits light in isolation is cased to emit light, and the sub-pixel of B is not caused to emit light (sub-pixel data 19 in FIG. 4(*a*)).

By this construction, the sub-pixel of G or R, which has a greater degree of contribution to luminance, is caused to emit light with respect to the sub-pixel of B. As a result, the lowering of contrast due to the presence of a pattern in which the sub-pixel of B having a lower degree of contribution to luminance emits light in isolation is prevented, whereby a high-quality binary image display is achieved.

Also, in this case, the pattern may be corrected to a pattern in which any one of the sub-pixels adjacent to both sides of the sub-pixel of B that emits light in isolation is caused to emit light, and the sub-pixel of B is also caused to emit light (sub-pixel data 18 in FIG. 4(*b*)).

With this construction, not only the sub-pixel of B but also the sub-pixel of G or R, having a greater degree of contribution to the luminance than the sub-pixel of B, is caused to emit light. As a result, a lowering in the contrast due to the presence of a pattern in which sub-pixel of B having a low degree of contribution to luminance emits light in isolation is suppressed, wherein a high-quality binary display is achieved.

Also, a specified light-emitting pattern that is searched by the correcting unit 7 is a pattern in which a set composed of sub-pixels of B and R adjacent to each other of the three primary colors R, G and B emits light in isolation in the first direction (sub-pixel data 20 in FIG. 4(*c*)).

In this case, the correcting unit 7 corrects to a pattern in which any one of the sub-pixels constituting the set is caused to emit light and the sub-pixel adjacent to the sub-pixel caused to emit light is caused to emit light (sub-pixel data 21 in FIG. 4(*c*)).

With this construction, no pattern resides, in which a set of the sub-pixels of BR having the lowest degree of contribution to luminance among the sets of sub-pixels of RG, BR and GB, emits light in isolation. Instead, a set of sub-pixels of RG or GB is caused to emit light.

As a result, lowering the contrast due to the presence of a pattern in which a set of sub-pixels of BR emits light in isolation is prevented, whereby a high-quality binary image display is achieved.

In the present embodiment, the row of sub-pixels (light-emitting elements of the display device 3) is in the order of R, G and B in the first direction. However, where the sub-pixels are arranged in the second direction, and where these are arranged in other rows such as B, G, and R, the present embodiment may be applicable as in the above, and an effect similar to that in the above description is achieved.

In addition, when multiple-value image data are inputted into the sub-pixel data generating unit 6 and multiple-value sub-pixel data are generated, the correcting unit 7 corrects the light-emitting pattern so that the contrast becomes high where multiple-value sub-pixel data having a specified light-emitting pattern (See FIG. 4) exist when the multiple-value sub-pixel data are judged on the basis (reference) of a threshold value defined in advance.

With this construction, even in a case where multiple-value image data are inputted, it is possible to confirm the presence of the specified light-emitting pattern and to correct the light-emitting pattern.

As a result, it is possible to prevent the contrast from being lowered due to any allocation of the light-emitting pattern of sub-pixels, whereby a high-quality multiple-value image display is achieved.

[Embodiment 2]

The entire configuration of a display apparatus according to a second embodiment of the invention is similar to that of the display apparatus shown in FIG. 1.

Figure 9:
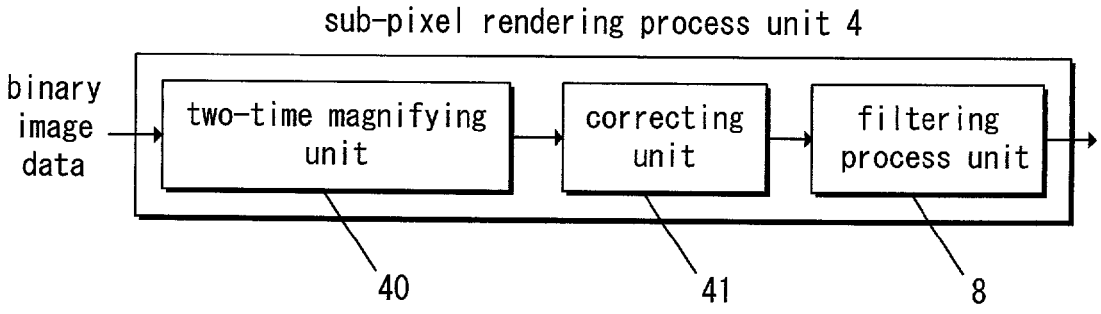
FIG. 9 is a block diagram of a sub-pixel rendering process unit according to a second embodiment of the invention.

FIG. 9 is a block diagram of sub-pixel rendering process unit of the display apparatus according to the second embodiment of the invention. Also, parts that are the same as those of the sub-pixel rendering process unit 4 in FIG. 2 are given the same reference numbers.

As shown in FIG. 9, the sub-pixel rendering process unit 4 includes a two-times magnifying unit 40, a correcting unit 41, and a filtering process unit 8.

Hereinafter, a description is given of actions of the respective components where it is assumed that display information inputted in the display information inputting unit 1 is binary image data.

The two-times magnifying unit 40 magnifies the inputted binary image data by a factor of two and generates sub-pixel data. A further detailed description is given of this point.

Figures 10A, 10B, 10C:
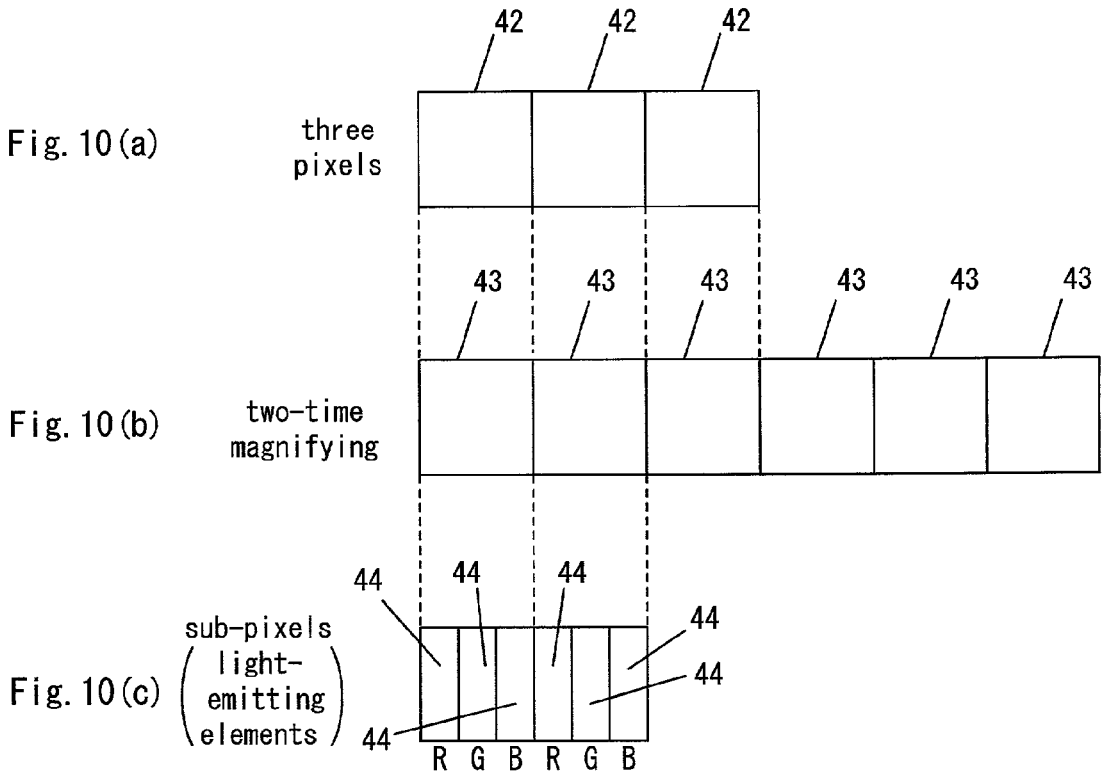
FIG. 10(*a*) is a view to which reference will be made in describing a sub-pixel data generating process according to the second embodiment of the invention.

FIGS. 10(*a*)–10(*c*) are views describing a two-times magnifying process. The three pixels of the inputted binary image data are noted for convenience of explanation.

The two-times magnifying unit 40 magnifies the inputted data 42 (FIG. 10(*a*)) of three pixels in the first direction in order to obtain six sub-pixel data 43 (FIG. 10(*b*)). The six sub-pixel data 43 are allocated to six sub-pixels (light-emitting elements) 44 (FIG. 10(*c*)).

As is clear from a comparison of FIG. 10(*a*) with FIG. 10(*c*), an image that is obtained by magnifying the inputted binary image by two-thirds in the first direction is brought about.

Based on the above description, if the first direction is a horizontal direction and the image data are fonts, a longitudinally long font is depicted by carrying out a two-times magnifying process.

Thus, if a sub-pixel display is performed by carrying out two-times magnification in the horizontal direction, the number of characters (number of fonts) that is displayed in the same width is increased.

FIGS. 11(*a*)–11(*b*) are views describing a degree of contribution to luminance regarding sub-pixel data that are obtained by the two-times magnifying process.

FIG. 11(*a*) indicates one line in the first direction of binary image data 100 that are inputted in the two-times magnifying unit 40. FIG. 11(*b*) indicates one line in the first direction of the sub-pixel data 101 that are generated by the two-times magnifying unit 40 on the basis of the binary image data 100.

For convenience of description, FIGS. 11(*a*)–11(*b*) show a state where the binary image data 100 are allocated to pixels and a state where sub-pixel data 101 are allocated to sub-pixels. However, the relationship between sub-pixels and pixels actually becomes as shown in FIGS. 10(*a*)–10(*c*) (that is, magnified by two-thirds). However, a description differing therefrom is employed in FIGS. 11(*a*)–11(*b*) for convenience of description.

As shown in FIGS. 11(*a*)–11(*b*), when data are magnified by the two-times magnifying process, data of one pixel 45 are allocated to sub-pixels 49 of R and G, data of one pixel 46 are allocated to sub-pixels 50 of B and R, data of one pixel 47 are allocated to sub-pixels 51 of G and B, and data of one pixel 48 are allocated to sub-pixels 52 of R and G.

That is, there exist three patterns of RG, BR and GB as patterns in which the inputted data of one pixel are allocated to sub-pixels.

By utilizing the fact that the degree of contribution of R, G and B to luminance is R:G:B=3:6:1, if the degrees of brightness are calculated with respect to the three patterns of RG, BR and GB, the degrees become RG:BR:GB=(3+6):(1+3):(6+1)=9:4:7.

Therefore, the brightness of the pattern BR is lowest in comparison with the other two patterns.

Accordingly, the sub-pixel data obtained by the two-times magnifying unit 40 are given to the correcting unit 41, whereby the pattern in which a set of sub-pixels B and R emits light in isolation is corrected to avoid a reduction in contrast.

Since the two-times magnifying process is carried out, no pattern (sub-pixel data 17 in FIGS. 4(*a*) and (*b*)) is generated, in which the sub-pixel of B that has the lowest degree of contribution to luminance emits light in isolation, even in a case where no correcting process is performed by the correcting unit 41, whereby no pattern in which the contrast is remarkably low is generated.

FIGS. 12(*a*)–12(*b*) are views describing a correcting process that is carried out by the correcting unit 41. FIG. 12(*a*) indicates binary image data 53 and sub-pixel data 60 for which the correcting process obtained therefrom is not carried out. FIG. 12(*b*) indicates binary image data 53 and sub-pixel data 61 for which the correcting process obtained therefrom is performed.

In FIG. 12, for convenience of description, a state where the binary image data 53 are allocated to pixels, and a state where sub-pixel data 60 and 61 are allocated to sub-pixels are shown. However, although the relationship between sub-pixels and pixels actually becomes as shown in FIGS. 10(*a*)–10(*c*) (that is, to be magnified by two-thirds), a description differing therefrom is employed in FIGS. 12(*a*)–12(*b*) for convenience of description. In FIGS. 12(*a*)–12(*c*), sections shown by diagonal lines express pixels and sub-pixels that are emitting light.

Herein, the sub-pixel data 60 for which no correcting process shown in FIG. 12(*a*) is carried out is considered to be sub-pixel data before being inputted into the correcting unit 41. Based on this thought, a description is given of rules of a correcting process by the correcting unit 41. Since image data that are inputted into the two-times magnifying unit 40 are binary image data, for simplification, a case where the sub-pixels are caused to emit light is expressed to be [ON], and a state where no sub-pixels are caused to emit light is expressed to be [OFF].

Also, where it is assumed that a row of sub-pixels in the display device 3 is in order of R, G and B, combinations of colors and light-emitting states of sub-pixels are expressed to be R(ON), R(OFF), G(ON), G(OFF), B(ON), and B(OFF).

As shown in FIG. 12(*a*), a row of sub-pixels in sub-pixel data 60 obtained from the binary image data 53 in which only the center pixel 54 emits light in isolation is R(OFF), G(OFF), B(ON), R(ON), G(OFF), and B(OFF), wherein, if the pattern is a specified light-emitting pattern (light-emitting pattern defined in advance) in which a set of B and R emits light in isolation, the correcting unit 41 carries out a correcting process so that the contrast becomes high, as shown in FIG. 12(*b*).

In detail, the correcting unit 41 corrects the sub-pixel data 60 having the specified light-emitting pattern so that the sub-pixel 55 of B emitting light is turned [OFF], and sub-pixels 56 and 57 of R and G are turned [ON], and the same correcting unit 41 generates sub-pixel data 61 in which the row of the sub-pixels becomes R(OFF), G(OFF), B(OFF), R(ON), G(ON), and B(OFF).

In addition to such correction, the light-emitting pattern of R(OFF), G(OFF), B(ON), R(ON), G(OFF), and B(OFF) may be corrected to a light-emitting pattern of R(OFF), G(ON), B(ON), R(OFF), G(OFF), and B(OFF).

Thus, by carrying out a correcting process in a case where a specified light-emitting pattern in which a set of B and R emits light in isolation exists, the output of the correcting unit 41 results in removing any pattern in which a set of B and R emits light in isolation, whereby sets which emit light in isolation become two sets of RG and GB.

Therefore, when correction is made to cause RG to emit light instead of BR, the comparison in the degree of contribution to luminance becomes RG:BR (RRG):GB=9:9:7. Also, when correction is made to cause GB to emit light instead of BR, the comparison in the degree of contribution to luminance becomes RG:BR (RGB):GB=9:7:7.

As a result, it is possible to make the entire contrast uniform, and almost simultaneously, it is possible to prevent a lowering in the contrast by a specified light-emitting pattern in which a set of BR emits light in isolation, bringing about a clear display.

On the other hand, where no correcting process is carried out, the row of sub-pixels becomes R(OFF), G(OFF), B(ON), R(ON), G(OFF), and B(OFF), a pattern in which a set of B and R emits light in isolation is maintained.

Figure 13A:
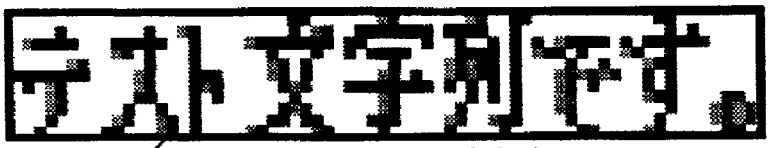
FIG. 13(*a*) is an image view where no correcting process is carried out in the second embodiment of the invention.
Figure 13B:
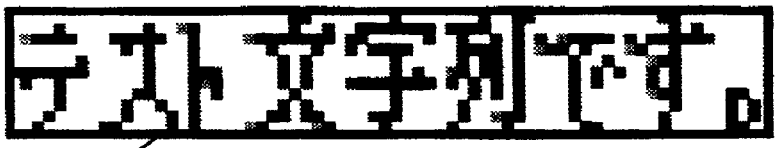

FIG. 13(*a*) is a view of an image 58 for which no correcting process is carried out, and FIG. 13(*b*) is an image 59 for which a correcting process is carried out. In comparing these images, it is found that the contrast with respect to lines in the longitudinal direction has been improved.

Based on the above, a description is given of a flow of processing in a display apparatus according to the second embodiment of the invention with reference to the drawing.

Figure 14:
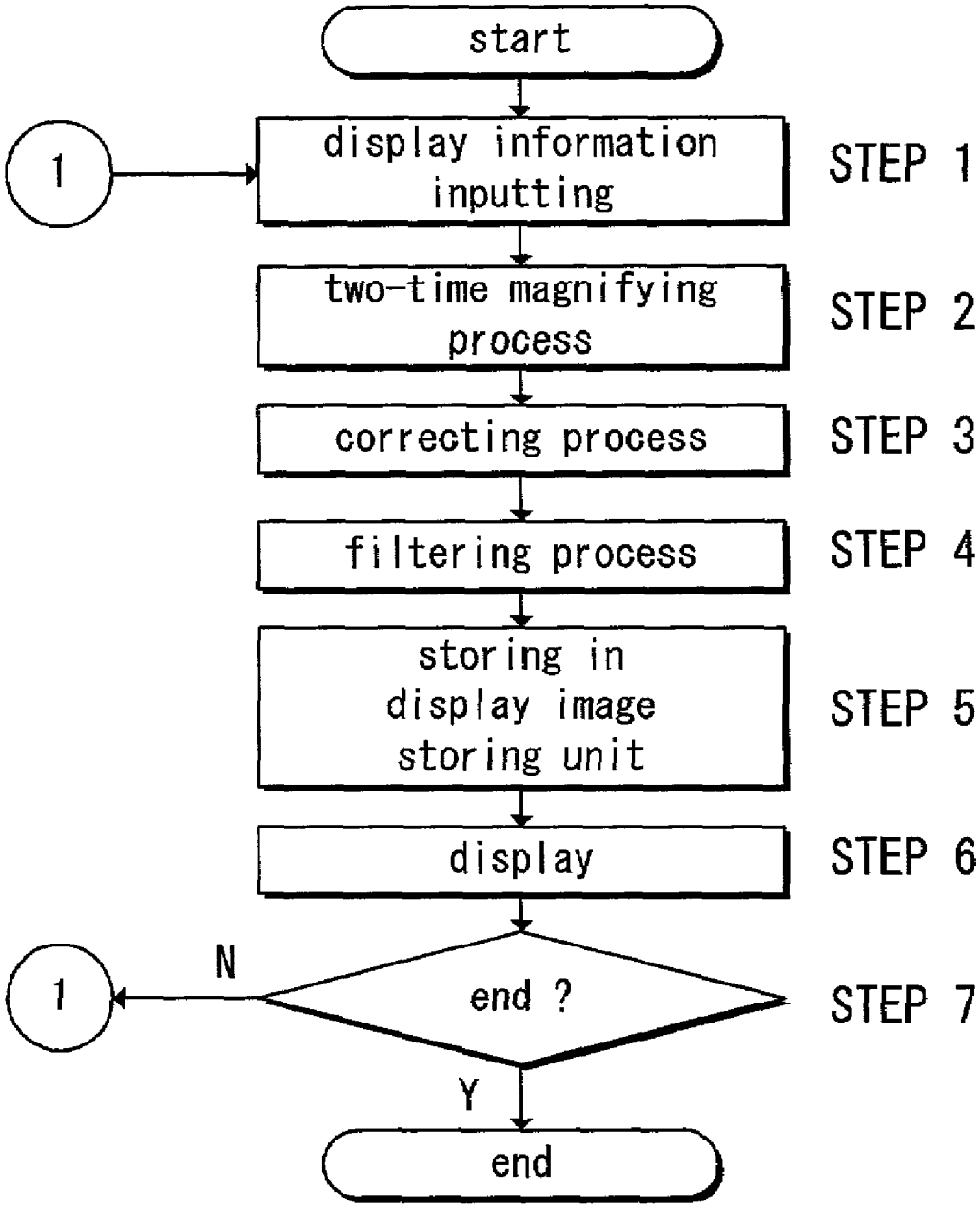
FIG. 14 is a flow chart of a display apparatus according to the second embodiment of the invention.

Referring now to the flow chart of FIG. 14, a display apparatus according to the second embodiment of the invention begins in STEP 1 where display information is inputted in the display information inputting unit 1. As described above, the inputted display information is binary image data.

Next, in STEP 2, the binary image data are given to the two-times magnifying unit 40 where they are magnified by a factor of two in the first direction to generate sub-pixel data.

Next, in STEP 3, the correcting unit 41 carries out a correcting process with respect to sub-pixel data that are inputted from the two-times magnifying unit 40.

A process from STEP 4 through STEP 7 corresponds to the process from STEP 4 through STEP 7 of FIG. 7.

Next, using FIGS. 12(*a*)–12(*b*) and the flow chart in FIG. 14, a description is given of a flow of a two-times magnifying process in STEP 2 of FIG. 14 and a correcting process in STEP 3 therein.

Figure 15:
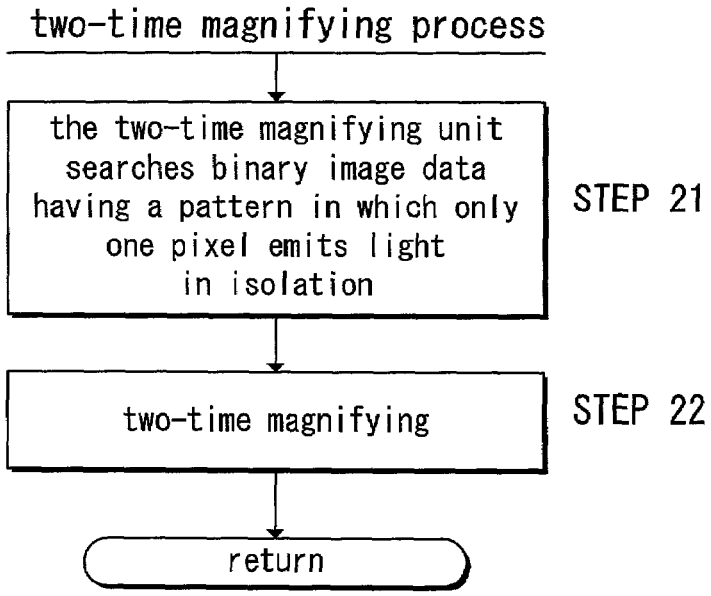
FIG. 15 is a flow chart of a two-times magnifying process in the second embodiment of the invention.
Figure 16:
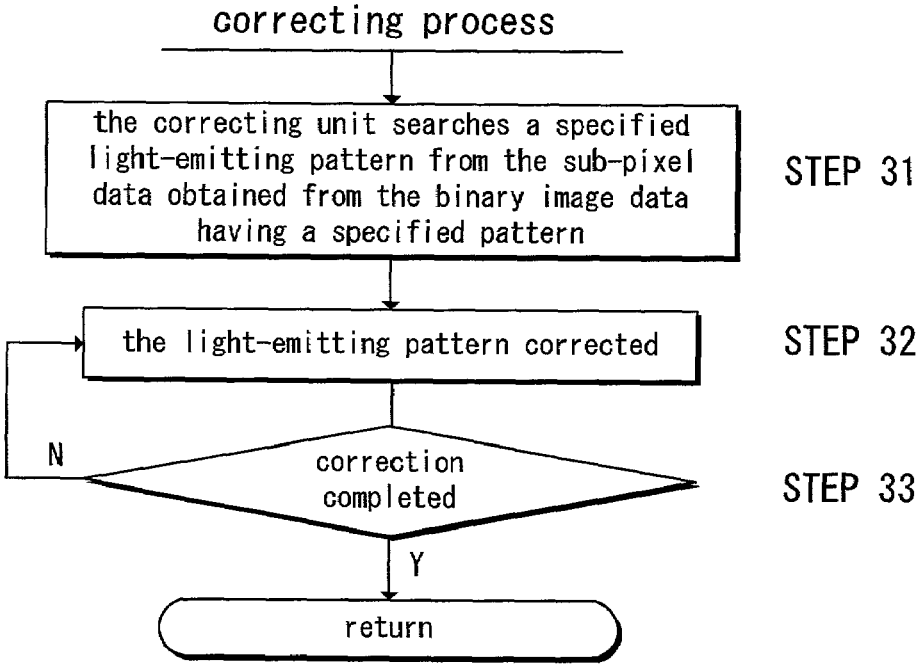
FIG. 16 is a flow chart of a correcting process according to the second embodiment of the invention.

FIG. 15 is a flow chart of a two-times magnifying process in STEP 2 in FIG. 14. FIG. 16 is a flow chart of a correcting process in STEP 3 in FIG. 14.

As shown in FIG. 15, in STEP 21, the two-times magnifying unit 40 searches binary image data having a pattern, in which only one pixel emits light in isolation, from the inputted binary image data.

In detail, as shown in FIGS. 12(*a*)–12(*b*), with respect to the inputted binary image data, the binary image data 53 having a pattern in which only one pixel 54 positioned at the center among three pixels adjacent to each other in the first direction emits light is searched.

In STEP 22, the two-times magnifying unit 40 magnifies the inputted binary image data by a factor of two in the first direction, and generates sub-pixel data. Also, sub-pixel data are generated for not only the binary image data searched in STEP 21 but also for all binary image data.

Further, as shown in FIG. 16, in STEP 31, the correcting unit 41 searches sub-pixel data (sub-pixel data 60 in FIG. 12(*a*)) having a pattern, in which a set of sub-pixels of B and R emits light in isolation, from the sub-pixel data obtained from the binary image data (binary image data 53 in FIG. 12) searched by the two-times magnifying unit 40 and having a pattern in which only one pixel emits light in isolation.

Although a pattern in which a set of sub-pixels of R and G emits light in isolation, and a pattern in which a set of sub-pixels of G and B emits light in isolation can exist in the sub-pixel data that are obtained from the binary image data (binary image data 53 in FIG. 12), searched by the two-times magnifying unit 40, in which only one pixel emits light in isolation, these light-emitting patterns are not searched in STEP 31.

In STEP 32, the correcting unit 41 carries out a correcting process with respect to the sub-pixel data (sub-pixel data 60 in FIG. 12(*a*)) having a specified light-emitting pattern searched, so that the contrast becomes high, and the corrected sub-pixel data are converted to new sub-pixel data (sub-pixel data 61 in FIG. 12(*b*)). In this case, the correcting process is subjected to the rules of the correcting process described in FIGS. 12(*a*)–12(*b*).

When correction is terminated with all sub-pixel data having a specified light-emitting pattern searched in STEP 32, the process shifts to STEP 4 in FIG. 14 (STEP 33).

As described above, in the present embodiment, the two-times magnifying unit 40 magnifies the inputted binary image data by a factor of two in the first direction to generate sub-pixel data.

With this construction, an image that is reduced to two-thirds in comparison with the binary image inputted into the two-times magnifying unit 40 is displayed on a display device 3. As a result, it is possible to increase the number of characters that can be displayed on a display device 3 of the same size.

In addition, when data of one pixel in the binary image data inputted into the two-times magnifying unit 40 are displayed on the display device 3, the data are allocated to two light-emitting elements (sub-pixels). As a result, no light-emitting pattern in which the contrast is remarkably low is generated.

When sub-pixel data having a specified light-emitting pattern exist in the sub-pixel data, the correcting unit 41 corrects the light-emitting pattern so that the contrast becomes high.

With this construction, where sub-pixel data having a specified light-emitting pattern exist, the light-emitting pattern is corrected so that the contrast becomes high, by setting a pattern to lower the contrast as the specified light-emitting pattern.

As a result, it is possible to prevent the contrast from being lowered due to the allocation of a light-emitting pattern to sub-pixels, whereby a high-quality binary image display is achieved.

In further detail, the specified light-emitting pattern that is searched by the correcting unit 41 is a pattern in which a set composed of sub-pixels of B and R adjacent to each other of the three primary colors of R, G and B emits light in isolation in the first direction (sub-pixel data 60 in FIG. 12(*a*)).

The correcting unit 41 causes any one (for example, sub-pixel 56 in FIG. 12(*b*)) of sub-pixels (sub-pixels 55 and 56 in FIG. 12(*a*)) which constitute the set of BR to emit light, and corrects the pattern to a pattern in which the sub-pixel (sub-pixel 57 in FIG. 12(*b*)) adjacent to the sub-pixel caused to emit light is caused to emit light (sub-pixel data 61 in FIG. 12(*b*)).

With this construction, no pattern exists, in which a set of sub-pixels BR having the lowest degree of contribution to luminance emits light in isolation, of sets of sub-pixels RG, BR and GB. Instead, a set of sub-pixels RG or GB emits light.

As a result, it is possible to prevent the contrast from being lowered due to the presence of a pattern in which a set of sub-pixels BR emits light in isolation, whereby a high-quality binary image display is achieved.

Summarizing the above description, in the present embodiment, by displaying a result obtained by magnifying a font by a two-times magnifying process in terms of sub-pixels, it is possible to reduce the width of characters and display more characters in the first direction, using a longitudinally long font, without degrading the quality. Also, the contrast becomes high by the correcting process, whereby it is possible to achieve a binary image display with greater visibility.

In this embodiment, the correcting unit 41 does not search sub-pixel data having a specified light-emitting pattern from all sub-pixel data inputted from the two-times magnifying unit 40, but searches sub-pixel data (sub-pixel data 60 in FIG. 12(*a*)) having a specified light-emitting pattern from the sub-pixel data obtained from the binary image data (binary image data 53 in FIG. 12) searched by the two-times magnifying unit 40 and having a specified light-emitting pattern in which one pixel emits light in isolation.

As a result, the time required to search a specified light-emitting pattern in the correcting unit 41 is reduced.

The row of sub-pixels (light-emitting elements of the display device 3) is in the order of R, G and B in the first direction in the present embodiment. However, where the sub-pixels are arranged in the second direction, and where these are arranged in other orders such as B, G, and R, the present embodiment may be applicable as in the above, and an effect similar to that in the above description is achieved.

[Embodiment 3]

A display apparatus according to a third embodiment is such that a feature of the display apparatus according to the first embodiment targeting binary image data is devised to be applicable to multiple-value image (grayscale) data.

Figure 17:
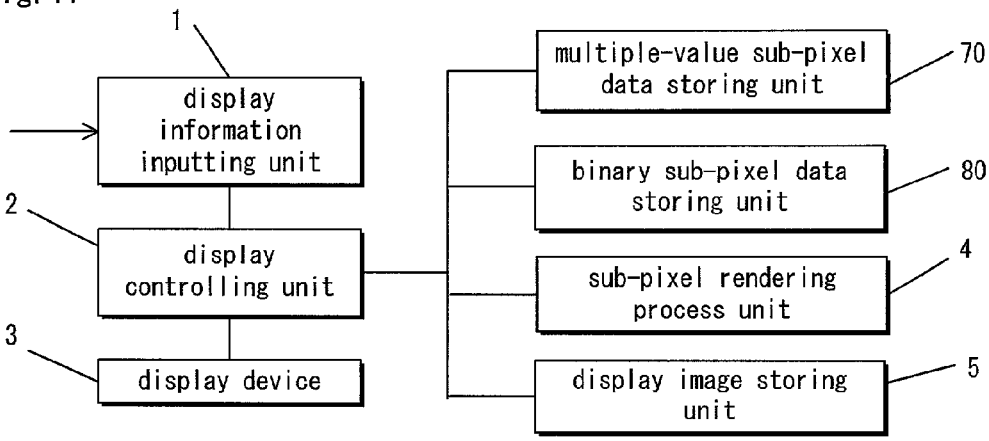
FIG. 17 is a block diagram of a display apparatus according to the third embodiment of the invention.

FIG. 17 is a block diagram of a display apparatus according to the third embodiment of the invention. Parts that are similar to those in FIG. 1 are given the same reference numbers, and overlapping description is appropriately omitted.

The display apparatus includes display information inputting unit 1, display controlling unit 2, a display device 3, a sub-pixel rendering process unit 4, a display image storing unit 5, a multiple-value sub-pixel data storing unit 70 and a binary sub-pixel data storing unit 80.

The multiple-value sub-pixel data storing unit 70 stores multiple-value sub-pixel data. The binary sub-pixel data storing unit 80 stores binary sub-pixel data.

Figure 18:
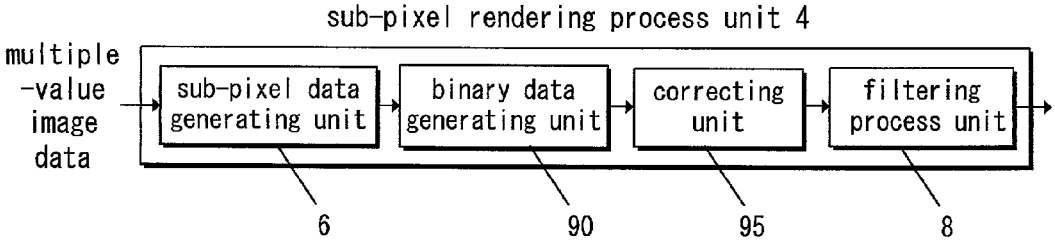
FIG. 18 is a block diagram of a sub-pixel rendering process unit according to the third embodiment of the invention.

Referring now to the block diagram in FIG. 18 the sub-pixel rendering process unit 4 in FIG. 17, in which parts that are similar to those in FIG. 2 are given the same reference numbers. Overlapping description of the similar parts is appropriately omitted.

The sub-pixel rendering process unit 4 includes sub-pixel data generating unit 6, a binary data generating unit 90, a correcting unit 95 and filtering process unit 8.

The sub-pixel data generating unit 6 generates multiple-value sub-pixel data on the basis of the inputted multiple-value image data. A process in this case is similar to that in the case where binary image data are inputted, whereby multiple-value sub-pixel data are obtained by magnifying the inputted binary multiple-value image data by 3 times, 3/2 times, 2 times, etc., at a magnification ratio that is optionally established. The multiple-value sub-pixel data thus obtained are stored in the multiple-value sub-pixel data storing unit 70.

The binary data generating unit 90 converts multiple-value sub-pixel data, which are inputted from the sub-pixel data generating unit 6, to binary sub-pixel data. The binary sub-pixel data thus obtained are stored in the binary sub-pixel data storing unit 80. The correcting unit 95 corrects multiple-value sub-pixel data, which are stored in the multiple-value sub-pixel data storing unit 70, so that the contrast thereof becomes high. This point will be described in further detail in a flow of processing made by a display apparatus according to the present embodiment.

Figure 19:
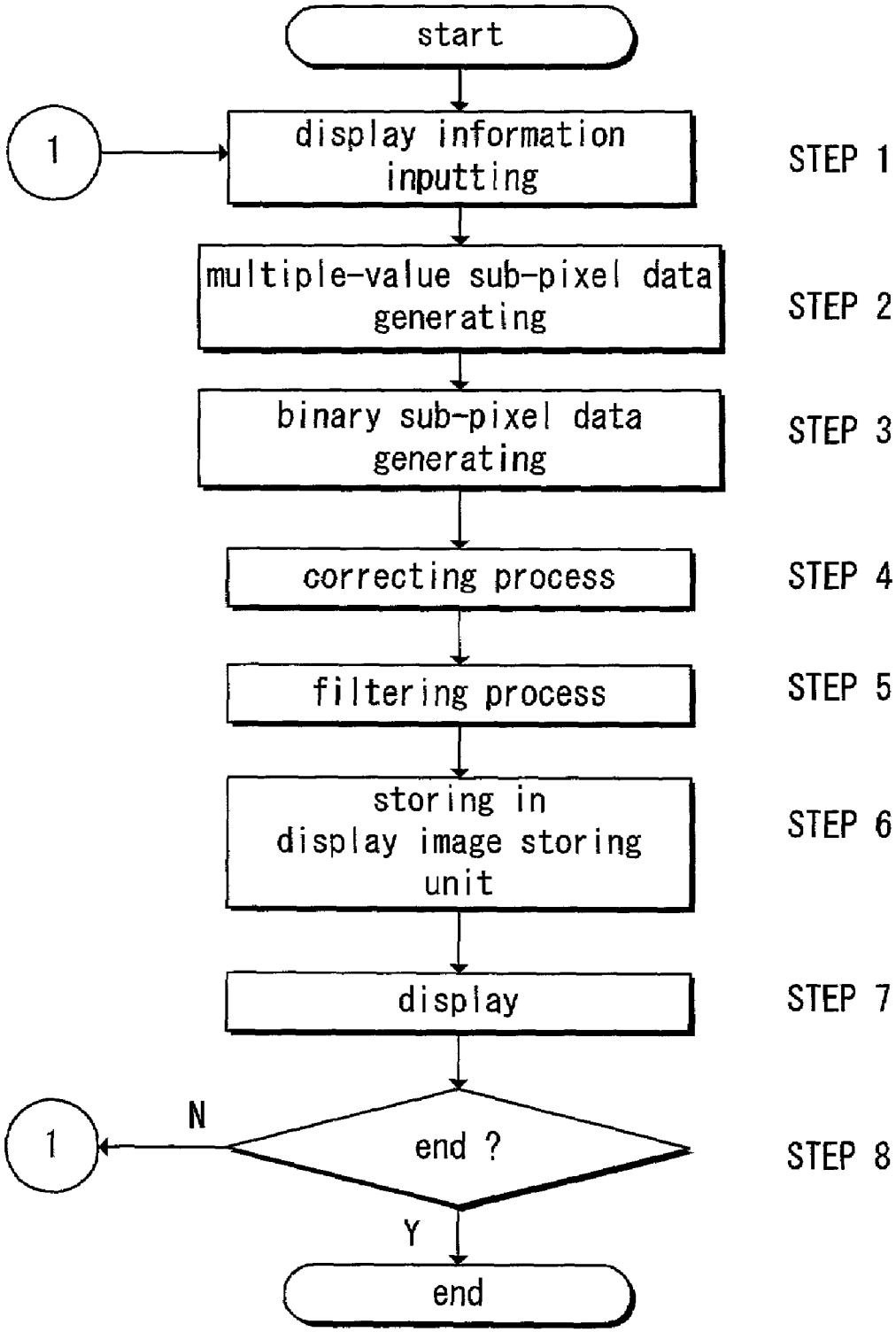
FIG. 19 is a flow chart of a display apparatus according to the third embodiment of the invention.

Referring now to the flow chart of FIG. 19, a display apparatus according to the present embodiment begins in STEP 1, where display information is inputted in the display information inputting unit 1. As described above, display information to be inputted is multiple-value image data.

Next, in STEP 2, the sub-pixel data generating unit 6 generates multiple-value sub-pixel data on the basis of the inputted multiple-value image data. A detailed process is similar to that in the first embodiment. For example, where an image having the same magnification as that of the inputted multiple-value image is displayed on a display device 3, the multiple-value image data are magnified by a factor of three in the first direction to generate multiple-value sub-pixel data.

The sub-pixel data generating unit 6 returns the generated multiple-value sub-pixel data to the display controlling unit 2. The display controlling unit 2 stores the received multiple-value sub-pixel data in the multiple-value sub-pixel data storing unit 70.

In STEP 3, the multiple-value sub-pixel data are provided to the binary data generating unit 90, wherein binary sub-pixel data are generated.

In detail, on the basis of the threshold value defined in advance, the binary data generating unit 90 determines a state where light is emitted or a state where no light is emitted, with respect to the inputted multiple-value sub-pixel data, thereby generating binary sub-pixel data.

In further detail, the binary data generating unit 90 compares multiple-value sub-pixel data, which are allocated to one sub-pixel, with the threshold value defined in advance. If the multiple-value sub-pixel data are greater than the threshold value defined in advance, the multiple-value sub-pixel data are converted to a state in which light is emitted. If the multiple-value sub-pixel data are smaller than the threshold value defined in advance, the multiple-value sub-pixel data are converted to a state in which no light is emitted, whereby binary sub-pixel data are generated, corresponding to the multiple-value sub-pixel data.

That is, when generating binary sub-pixel data, the binary data generating unit 90 determines a state where light is emitted or a state where no light is emitted, on the basis of a magnitude in the case where the multiple-value sub-pixel data corresponding to one sub-pixel are compared with the threshold value defined in advance, and binary sub-pixel data corresponding to the multiple-value sub-pixel data are generated.

By this method, the binary data generating unit 90 determines a state where light is emitted or a state where no light is emitted, with respect to all inputted multiple-value sub-pixel data, and generates binary sub-pixel data. As described above, it is possible to simply generate the binary sub-pixel data.

The binary data generating unit 90 returns the generated binary sub-pixel data to the display controlling unit 2. The display controlling unit 2 stores the received binary sub-pixel data in the binary sub-pixel data storing unit 80.

Next, in STEP 4, the correcting unit 95 carries out a correcting process for the multiple-value sub-pixel data stored in the multiple-value sub-pixel data storing unit 70 with reference to the binary sub-pixel data that are stored in the binary sub-pixel data storing unit 80.

Figure 20:
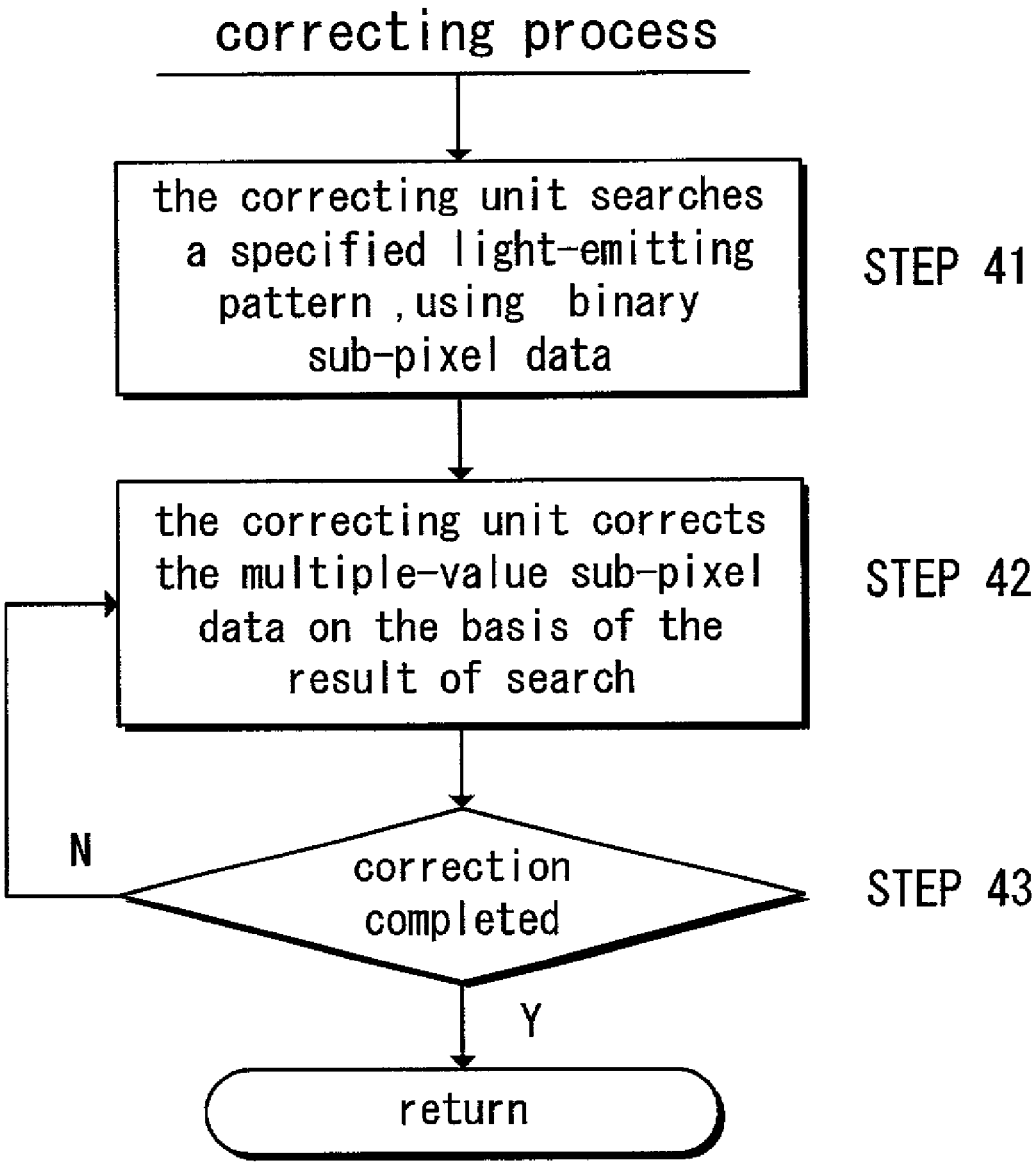
FIG. 20 is a flow chart of a correcting process according to the third embodiment of the invention.

Referring now to the flow chart in FIG. 20 of a correcting process in STEP 4 in FIG. 19. In STEP 41, the correcting unit 95 searches a specified light-emitting pattern, using binary sub-pixel data.

A specified light-emitting pattern that is searched at this time is similar to that in the first embodiment, and is a pattern in which sub-pixel of B emits light in isolation and a pattern in which a set of sub-pixels of BR emits light in isolation.

Herein, a description is given of an example, that is search of a specified light-emitting pattern in a case where multiple-value image data are magnified by a factor of two, and multiple-value sub-pixel data and binary sub-pixel data are generated.

In this example, a specified light-emitting pattern is searched by using binary sub-pixel data, which are generated on the basis of multiple-value image data of one pixel, as a unit. This point is described, using the drawings.

Figure 21:
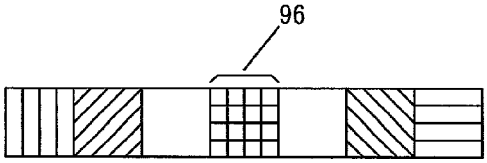
FIG. 21(*a*) is a view exemplifying multiple-value image data that are inputted in a sub-pixel data generating unit according to the third embodiment of the invention.
Figure 21:
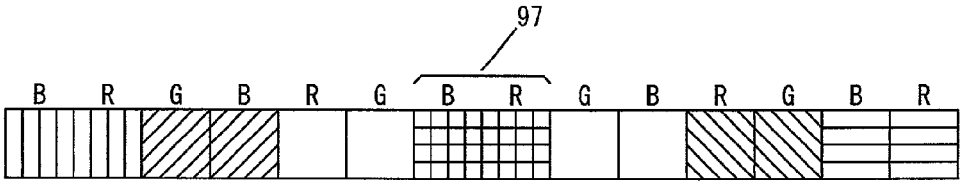
Figure 21:
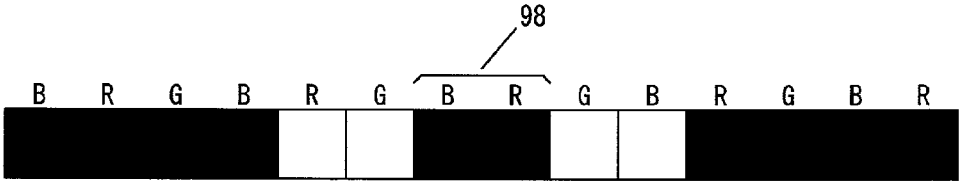
Figure 24:
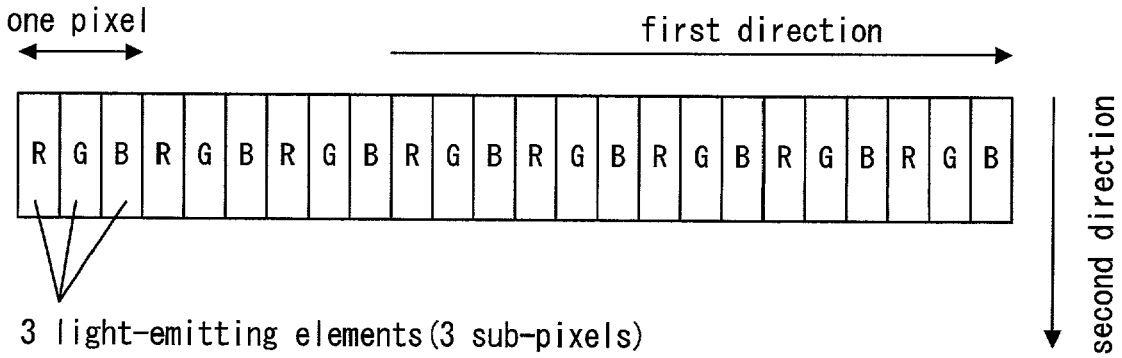
Fig. 24 Prior Art
FIG. 24 is an exemplary view of one line according to a prior art.
Figure 25:
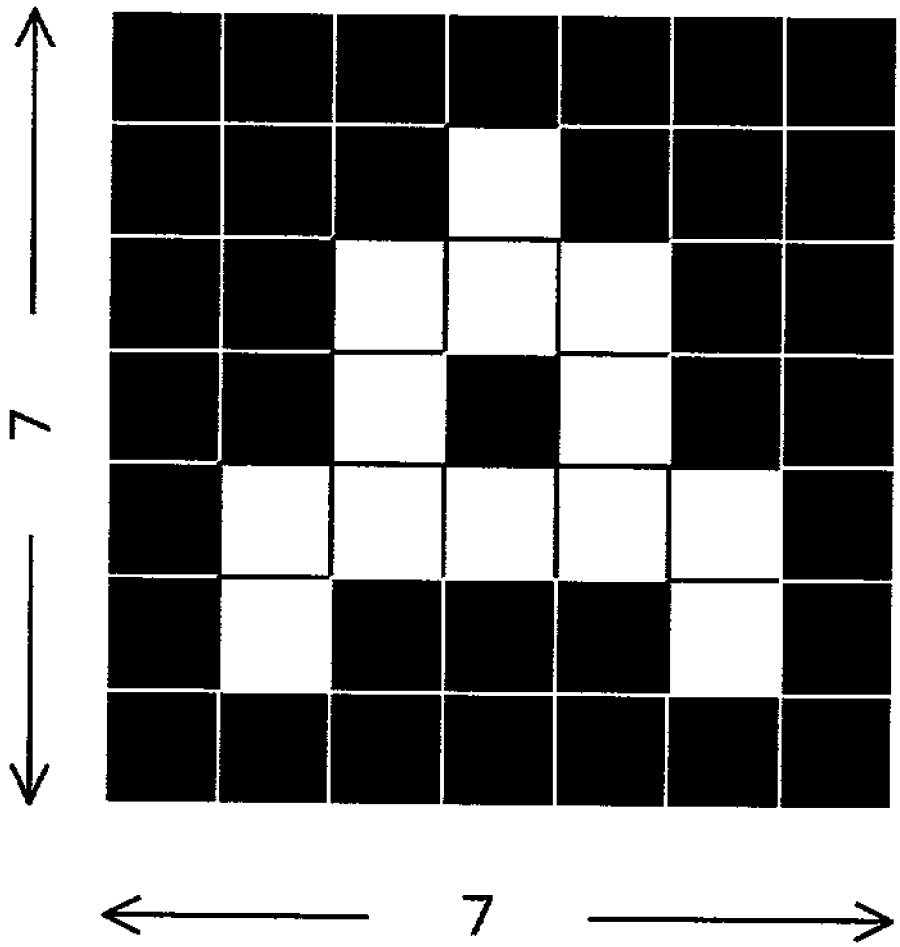
Fig. 25 Prior Art
FIG. 25 is a view exemplifying an original image according to the prior art.
Figure 26:
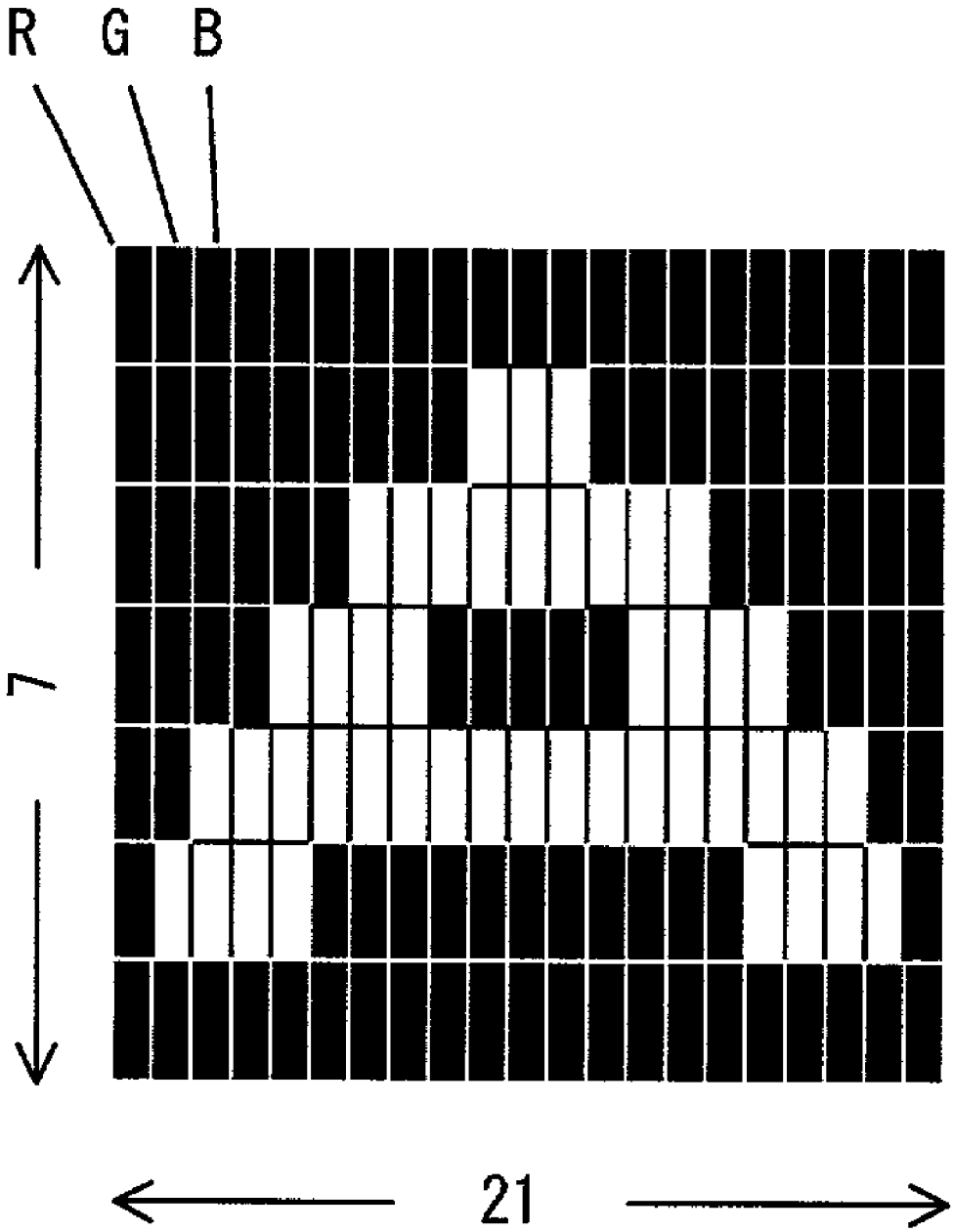
Fig. 26 Prior Art
FIG. 26 is a view exemplifying a triple-time magnified image according to the prior art.
Figure 27:
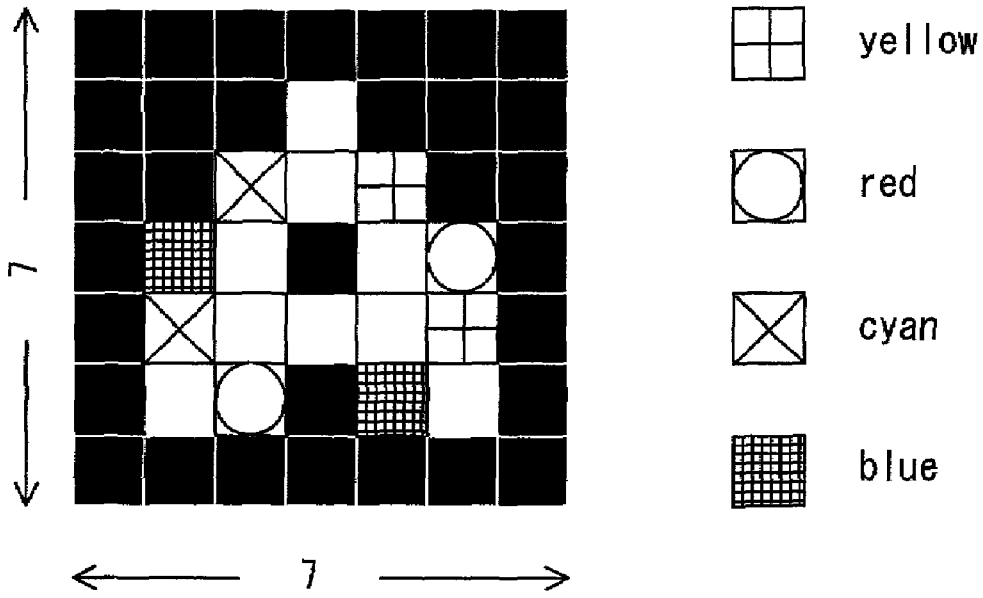
Fig. 27 Prior Art
FIG. 27 is a view to which reference will be made in describing a color determining process according to the prior art.
Figures 28A, 28B:
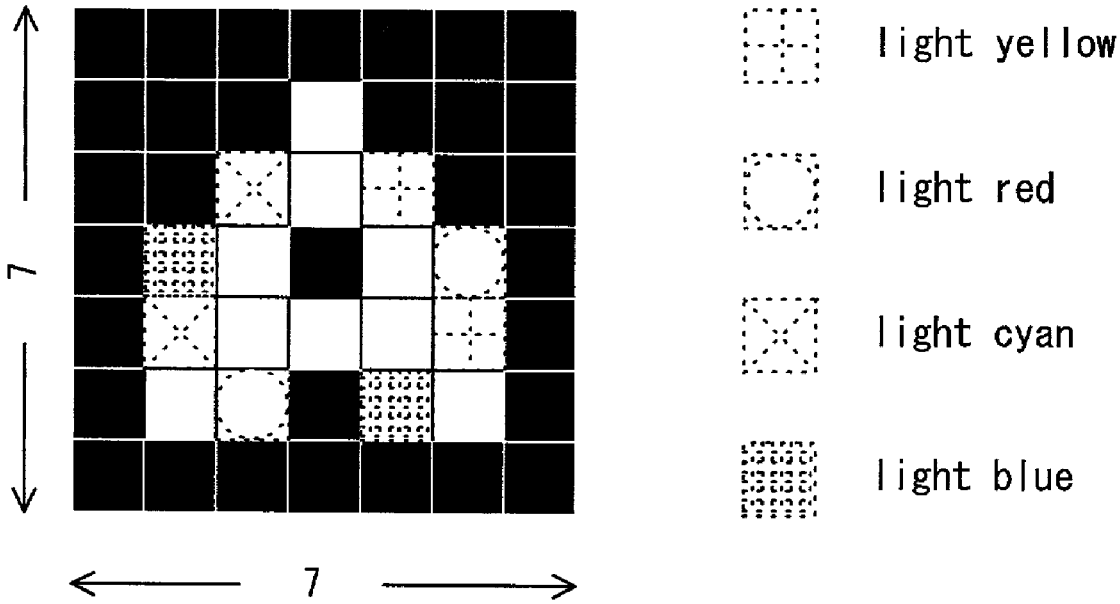
Fig. 28(a) Prior Art
Fig. 28(b) Prior Art
FIG. 28(*a*) is a view to which reference will be made in describing coefficients for a filtering process according to the prior art.
Figure 29:
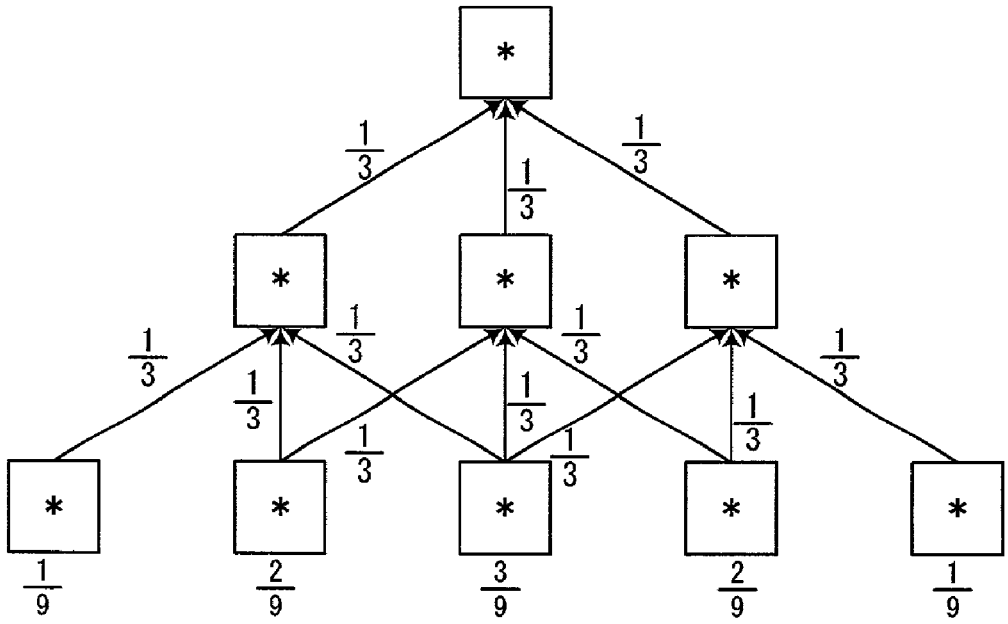
Fig. 29 Prior Art
FIG. 29 is a view to which reference will be made in describing coefficients for a filtering process according to the prior art.

FIGS. 21(*a*)–21(*c*) are views describing a retrieving process of a specified light-emitting pattern in the binary sub-pixel data obtained by magnifying the multiple-value sub-pixel data by a factor of two.

FIG. 21(*a*) is a view exemplifying multiple-value image data inputted into the sub-pixel data generating unit 6. FIG. 21(*b*) is a view exemplifying the multiple-value sub-pixel data that are generated by magnifying the multiple-value image data in FIG. 21(*a*) by a factor of two in the first direction. FIG. 21(*c*) is a view exemplifying the binary sub-pixel data that are generated on the basis of the multiple-value sub-pixel data in FIG. 21(*b*).

Also, in FIGS. 21(*a*)–21(*c*), multiple-value image data or sub-pixel data are illustrated by sectioning the same pixel-by-pixel or sub-pixel-by-sub-pixel. Also, it is indicated that the multiple-value sub-pixel data in FIG. 21(*b*), which are of the same type as the multiple-value image data in FIG. 21(*a*) and hatched therein, are generated from the multiple-value image data.

As shown in FIGS. 21(*a*) and 21(*b*), multiple-value sub-pixel data 97 that are allocated to two sub-pixels are generated from the multiple-value 96 of one pixel. And, as shown in FIGS. 21(*b*) and (*c*)), binary sub-pixel data 98 are generated on the basis of the multiple-value sub-pixel data 97 that are allocated to two sub-pixels.

The binary sub-pixel data 98 (corresponding to the multiple-value image data of one pixel) that are thus generated are used as one unit, whereby a specified light-emitting pattern (a pattern in which a set of sub-pixels of BR emits light in isolation) is searched.

Thereby, as shown in FIG. 21(*c*), it can be searched that binary sub-pixel data 98 being one unit of search emit light in isolation.

The description now returns to FIG. 20. In STEP 42 next to STEP 41, the correcting unit 95 corrects the multiple-value sub-pixel data on the basis of the result of search in STEP 41, so that the contrast becomes high. This point is described, including a process in STEP 41, using a detailed example.

FIGS. 22(*a*)–22(*c*)) are conceptual views showing a state where sub-pixel data are allocated to sub-pixels. The drawing illustrates the rules of a correcting process in the correcting unit 95.

A row of sub-pixels (light-emitting elements) in the display device 3 is in order of R, G and B. FIGS. 22(*a*)–22(*c*) shows sub-pixels that are arranged in order of G, B, and R. In respective FIGS. 22(*a*), 22(*b*) and 22(*c*), multiple-value sub-pixel data before correction, binary sub-pixel data, and multiple-value sub-pixel data after correction are shown.

In the binary sub-pixel data, for simplification, sub-pixel data in a case where the sub-pixels (light-emitting elements) are caused to emit light is expressed as [ON], and sub-pixel data in a case where the sub-pixels (light-emitting elements) are not caused to emit light is expressed as [OFF].

In the following description, in the case of binary sub-pixel data, combinations of colors and light-emitting states of sub-pixels (light-emitting elements) are expressed as R(ON), R(OFF), G(ON), G(OFF), B(ON), and B(OFF).

In FIG. 22(*a*), the sub-pixel data 102 before correction are in order of G, B and R and are denoted by [100], [200] and [90], respectively. It is assumed that binary sub-pixel data 103 are generated on the basis of the sub-pixel data 102 before correction, using the threshold value defined in advance as a reference, and the threshold value defined in advance at this time is [128].

As shown in FIG. 22(*a*), the correcting unit 95 searches binary sub-pixel data 103, having a specified light-emitting pattern (a light-emitting pattern defined in advance) in which a sub-pixel of B (Blue) emits light in isolation, in which a row of the sub-pixels is G (OFF), B (ON), and R (OFF) (STEP 41 in FIG. 20).

Taking note of data B [200] which will emit light in isolation where the binary sub-pixel data 103 of the multiple-value sub-pixel data 102 are employed, the correcting unit 95 corrects the data B [200] to the data G [100] adjacent to one side thereof, and corrects the data R [90] adjacent to the other side thereof to the data B [200]. At the same time, the data G [100] adjacent to one side thereof remains as it is. The multiple-value sub-pixel data 102 are converted to new multiple-value sub-pixel data 104 (STEP 42 in FIG. 20).

That is, the correcting unit 95 judges the multiple-value sub-pixel data on the basis of the threshold value defined in advance and searches multiple-value sub-pixel data 103 having a pattern in which a sub-pixel of B emits light in isolation, whereby multiple-value sub-pixel data 104 for which the light-emitting pattern is corrected so that the contrast becomes high are obtained.

Further, as shown in FIG. 22(*b*), taking note of data B [200] which will emit light in isolation where the binary sub-pixel data 103 of the multiple-value sub-pixel data 102 are employed, the correcting unit 95 renders the data B [200] and data G [100] adjacent to one side thereof to remain as they are, and the same correcting unit 95 corrects the data R [90] adjacent to the other end thereof to the data B [200], whereby the multiple-value sub-pixel data 102 is converted to new multiple-value sub-pixel data 105 (STEP 42 in FIG. 20).

That is, the correcting unit 95 judges the multiple-value sub-pixel data on the basis of the threshold value defined in advance and searches multiple-value sub-pixel data 103 having a pattern in which a sub-pixel of B emits light in isolation, whereby multiple-value sub-pixel data 105 for which the light-emitting pattern is corrected so that the contrast becomes high are obtained.

In FIG. 22(*c*), the sub-pixel data 106 before correction are in order of G, B, R and G in the first direction, which are denoted as [100], [200], [150] and [90], respectively. And, it is assumed that binary sub-pixel data 107 are generated on the basis of the sub-pixel data 106 before the correction with reference to the threshold value defined in advance. Also, in this case, the threshold value defined in advance is assumed to be [128].

As shown in FIG. 22(*c*), the correcting unit 95 searches binary sub-pixel data 107, in which a row of sub-pixels is G (OFF), B (ON), R (ON), G (OFF), having a specified light-emitting pattern in which a set of sub-pixels B (Blue) and R (Red) emits light in isolation (STEP 41 in FIG. 20).

Taking note of data BR [200] and [150] which will emit light in isolation where the binary sub-pixel data 107 of the multiple-value sub-pixel data 106 are employed, the correcting unit 95 corrects the data B [200] of BR to [100] that is data G adjacent thereto, the data R [150] of BR to data B [200] of BR, and the data G [90] adjacent to the data R [150] of BR to the data R [150] of BR, and at the same time, the correcting unit 95 causes the data G [100] adjacent to the data B [200] of BR to remain as it is, whereby the multiple-value sub-pixel data 106 are converted to new multiple-value sub-pixel data 108 (STEP 42 in FIG. 20).

That is, the correcting unit 95 judges the multiple-value sub-pixel data on the basis of the threshold value defined in advance and searches the multiple-value sub-pixel data 106 having a light-emitting pattern in which a set of sub-pixels B and R emits light in isolation, whereby multiple-value sub-pixel data 108 for which a light-emitting pattern is corrected so that the contrast becomes high are obtained.

Rules for the correcting process shown below may be used in addition to the rules of the correcting process, which are shown in FIGS. 22(*a*)–22(*c*).

FIGS. 23(*a*)–23(*c*) show another example of rules of the correcting process in the correcting unit 95. Parts that are similar to those in FIGS. 22(*a*)–22(*c*) are given the same reference numbers, and description thereof is omitted.

As shown in FIG. 23(*a*), the correcting unit 95 searches binary sub-pixel data 103, in which a row of sub-pixels is G (OFF), B (ON), and R (OFF), having a specified light-emitting pattern (light-emitting pattern defined in advance) in which a sub-pixel of B (Blue) emits light in isolation. (STEP 41 in FIG. 20).

Taking note of data B [200] which will emit light in isolation where the binary sub-pixel data 103 of the multiple-value sub-pixel data 102 are employed, the correcting unit 95 corrects the data B [200] to the data R [90] adjacent to one side thereof, and corrects the data G [100] adjacent to the other side thereof to the data B [200]. At the same time, the correcting unit 95 causes the data R [90] adjacent to one side thereof to remain as it is. The multiple-value sub-pixel data 102 are converted to new multiple-value sub-pixel data 109 (STEP 42 in FIG. 20).

As shown in FIG. 23(*b*), taking note of data B [200] which will emit light in isolation where the binary sub-pixel data 103 of the multiple-value sub-pixel data 102 are employed, the data B [200] and data R [90] adjacent to one side thereof are caused to remain as they are. The data G [100] adjacent to the other side thereof is corrected to the data B [200], whereby the multiple-value sub-pixel data 102 is converted to new multiple-value sub-pixel data 110 (Step 42 in FIG. 20).

On the other hand, as shown in FIG. 23(*c*), the correcting unit 95 searches binary sub-pixel data 107, in which a row of sub-pixels is G (OFF), B (ON), R (ON) and G (OFF), having a specified light-emitting pattern in which a set of sub-pixels B (Blue) and R (Red) emits light in isolation (STEP 41 in FIG. 20).

Taking note of data BR [200] and [150] which will emit light in isolation where the binary sub-pixel data 107 of the multiple-value sub-pixel data 106 are employed, the correcting unit 95 corrects the data R [150] of BR to the data G [90] adjacent thereto, the data B [200] of BR to the data R [150] of BR, and the data G [100] adjacent to the data B [200] of BR to the data B [200] of BR, and the correcting unit 95 causes the data G [90] adjacent to the data R [150] of BR to remain as it is, whereby the multiple-value sub-pixel data 106 are converted to new multiple-value sub-pixel data 111 (STEP 42 in FIG. 20).

As described above, where the display device 3 performs a multiple-value image display after the correction as shown in FIG. 22(*a*) or FIG. 23(*a*), light emission of the sub-pixel of B, which intensively emits more light than the sub-pixels of G and R adjacent thereto, is weakened. Instead, the sub-pixel G or R having a higher degree of contribution to luminance than the sub-pixel of B intensively emits light.

As a result, it is possible to prevent the contrast from being lowered due to a cause where only the sub-pixel of B having a lower degree of contribution to luminance intensively emits more light than the sub-pixels G and R adjacent thereto, whereby a high-quality multiple-value image display is achieved.

Also, where the display device 3 performs a multiple-value image display after the correction as shown in FIG. 22(*b*) or FIG. 23(*b*), not only does the sub-pixel of B having a low degree of contribution to luminance intensively emit light, but also the sub-pixel of G or R having a higher degree of contribution to luminance than that of the sub-pixel of B also intensively emits light.

As a result, it is possible to prevent the contrast from being lowered due to a cause where only the sub-pixel of B having a lower degree of contribution to luminance intensively emits more light than the sub-pixels G and R adjacent thereto, whereby a high-quality multiple-value image display is achieved.

Where the display device 3 performs a multiple-value image display after the correction as shown in FIG. 22(*c*) or FIG. 23(*c*), light emission of the set of sub-pixels BR having the lowest degree of contribution to luminance among the sub-pixels of RG, BR and GB is weakened. Instead, the set of sub-pixels of RG or GB intensively emits more light.

As a result, it is possible to prevent the contrast from being lowered due to a cause where the set of sub-pixels of BR intensively emits more light than in the sub-pixels adjacent thereto, whereby a high-quality multiple-value image display is achieved.

The description now returns to FIG. 19. In STEP 5, the filtering process unit 8 filters multiple-value sub-pixel data for which a correcting process has been carried out. A detailed filtering process is similar to that in the first embodiment.

In STEP 6, the display controlling unit 2 stores multiple-value sub-pixel data, for which a filtering process has been carried out, in the display image storing unit 5.

In STEP 7, the display controlling unit 2 allocates multiple-value sub-pixel data, which are stored in the display image storing unit 5, to three light-emitting elements, constituting one pixel, of the display device 3, and makes the display device 3 perform display.

The display controlling unit 2 returns the process to STEP 1 unless display is terminated (in STEP 8).

As described above, in the present embodiment, the binary data generating unit 90 determines a state where light is emitted or a state where no light is emitted, on the basis of the threshold value defined in advance with respect to the multiple-value sub-pixel data, whereby binary sub-pixel data are generated (STEP 3 in FIG. 19).

Next, the correcting unit 95 searches binary sub-pixel data having a specified light-emitting pattern from binary sub-pixel data (STEP 41 in FIG. 20).

Next, where binary sub-pixel data having a specified light-emitting pattern is searched, the correcting unit 95 corrects a light-emitting pattern of the multiple-value sub-pixel data corresponding to the searched binary sub-pixel data, so that the contrast becomes high. (STEP 42 in FIG. 20).

With this construction, by setting a specified light-emitting pattern to a pattern by which contrast is lowered, if there exist binary sub-pixel data having the specified light-emitting pattern, the light-emitting pattern of the corresponding multiple-value sub-pixel data is corrected so that the contrast becomes high. (Refer to FIGS. 22(*a*)–23(*c*)).

As a result, it is possible to prevent the contrast from being lowered due to allocation of a light-emitting pattern to sub-pixels, whereby a high-quality multiple-value image display is achieved.

Where both of a difference between the noted multiple-value sub-pixel data and multiple-value sub-pixel data adjacent to one side (left side) thereof, and a difference between the noted multiple-value sub-pixel data and multiple-value sub-pixel data adjacent to the other side (right side) thereof are greater than the threshold value defined in advance, it is judged that the noted multiple-value sub-pixel data emit light in isolation, whereby correction may be carried out with respect to the multiple-value sub-pixel data in compliance with the rules shown in FIGS. 22(*a*)–23(*c*), so that the contrast becomes high.

Herein, a display apparatus according to the first embodiment through the third embodiment may be constituted as a portable terminal such as, for example, a cellular telephone, PDA (Personal Digital Assistants), etc.

Also, a process used in a display apparatus according to the first embodiment through the third embodiment may be executed in, for example, an LSI (Large-Scale Integrated Circuit) for depiction.

Further, a displaying method in a display apparatus according to the first embodiment through the third embodiment may be mounted in a personal computer in which, for example, an OS (operating system) is pre-installed.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display method for a display device of a type in which three light-emitting elements, which respectively emit light of the three primary colors of R, G, and B, comprising:

aligning said three light-emitting elements in a fixed order to form one pixel;

aligning a first plurality of said pixels in a first direction to form one line;

aligning a second plurality of lines in a second direction, that is orthogonal to said first direction, to form a display screen;

calculating sub-pixel data from data of an image to be displayed;

defining in advance a light-emitting pattern in said sub-pixel data;

said pattern including isolated sub-pixels making a small contribution to contrast;

correcting said sub-pixel data when said sub-pixel data matches said pattern;

the step of correcting including allocating sub-pixel data to at least one additional sub-pixel adjacent said isolated sub-pixel, whereby an image contrast is improved; and applying corrected sub-pixel data to said display device.

2. The display method according to claim 1, wherein said image data to be displayed are binary image data.

3. The display method according to claim 1, wherein the step of calculating includes comparing said sub-pixels with a threshold value defined in advance, whereby said contrast is improved.

4. The display according to claim 1, wherein:

the step of defining includes defining a light-emitting pattern in which a sub-pixel of B of said three primary colors R, G and B aligned in said first direction emits light in isolation; and the step of correcting includes correcting said light-emitting pattern to a pattern in which any one of said sub-pixels adjacent to a side of said sub-pixel of B that emits light in isolation is caused to emit light, and said sub-pixel of B is not caused to emit light.

5. The display method according to claim 1, wherein:

the step of defining includes defining in advance a pattern in which a sub-pixel of B of said three primary colors R, G and B aligned in said first direction emits light in isolation; and the step of correcting includes correcting said pattern to a pattern in which any one of said sub-pixels adjacent sides of said sub-pixel of B that emits light in isolation is caused to emit light, and said sub-pixel of B is caused to emit light.

6. The display method according to claim 1, wherein:

the step of defining includes defining in advance a pattern in which a set composed of sub-pixels of B and R adjacent to each other of said three primary colors R, G and B emits light in isolation in said first direction;

the step of correcting includes correcting said pattern to a pattern in which any one of said sub-pixels constituting said set is caused to emit light, and at least one sub-pixel adjacent to said sub-pixel caused to emit light is caused to emit light.

7. A display method which performs display with a display device, with which three light-emitting elements, which respectively emit light of the three primary colors of R, G, and B, comprising:

aligning said three light-emitting elements in a fixed order to form one pixel;

aligning a first plurality of said pixels in a first direction to form one line;

aligning a second plurality of lines in a second direction, that is orthogonal to said first direction, to form a display screen;

magnifying data of an image to be displayed by a factor of two in said first direction to generate sub-pixel data; and allocating sub-pixel data to said light-emitting elements corresponding thereto;

defining a light-emitting pattern to develop a defined light-emitting pattern, wherein one defined light-emitting pattern is a pattern in which a set composed of sub-pixels of B and R adjacent to each other in said first direction emits light in isolation;

comparing a light-emitting pattern of said light-emitting elements with said defined light-emitting pattern to identify light-emitting elements requiring correcting;

correcting said light-emitting pattern in response to said comparing step so that contrast is improved when said defined light-emitting pattern exists in said sub-pixel data, wherein if the correcting step includes correcting said light-emitting pattern to a pattern in which any one of sub-pixels constituting pixel is caused to emit light, a sub-pixel in pixels adjacent to said sub-pixel caused to emit light is caused to emit light; and displaying, after the correcting step, corrected said sub-pixel data on said display device.

8. The display method according to claim 7, wherein said data of an image to be displayed are binary image data.

9. The display method according to claim 7, wherein:

the step of defining, includes judging said sub-pixel data obtained from said image data on the basis of a threshold value defined in advance; and the step of correcting is responsive to sub-pixel data exceeding said threshold, whereby a displayed light-emitting pattern is corrected so that contrast is improved.

10. A display method which performs display with a display device, with which three light-emitting elements, which respectively emit light of said three primary colors of R, G, and B, comprising:

aligning said three light-emitting elements in a fixed order to form one pixel;

aligning a first plurality of said pixels in a first direction to form one line;

aligning a second plurality of lines in a second direction, that is orthogonal to said first direction, to form a display screen;

searching data of an image among images to be displayed having a pattern in which only one pixel positioned at the center thereof emits light, from three pixels adjacent to each other in said first direction;

generating sub-pixel data by magnifying data of said image to be displayed, by a factor of two in said first direction;

searching said sub-pixel data having a light-emitting pattern defined in advance from said sub-pixel data corresponding to data of said image where data of an image having said pattern, in which only one pixel positioned at the center emits light, exist according to a result of the step of searching data;

correcting a light-emitting pattern so that said contrast is improved where sub-pixel data having said light-emitting pattern defined in advance, exist according to the result of the step of searching said sub-pixel data;

allocating said sub-pixel data to said light-emitting elements corresponding thereto after the correcting step; and displaying corrected data on with said display device.

11. The display method according to claim 10, wherein said image data to be displayed are binary image data.

12. The display method according to claim 10, wherein:

the step of searching said sub-pixel data includes searching for said light-emitting pattern defined in advance containing a set composed of sub-pixels of B and R adjacent to each other of said three primary colors R, G and B aligned in said first direction which emits light in isolation; and the step of correcting includes correcting said pattern to a corrected pattern in which any one of said sub-pixels constituting said set is caused to emit light, and a sub-pixel adjacent to said sub-pixel caused to emit light is also caused to emit light.

13. A display method which performs display with a display device, with which three light-emitting elements, which respectively emit light of said three primary colors of R, G, and B, comprising:

aligning said three light-emitting elements in a fixed order to form one pixel;

aligning a first plurality of said pixels in a first direction to form one line;

aligning a second plurality of lines in a second direction, that is orthogonal to said first direction, to form a display screen;

generating binary sub-pixel data by determining a state of emitting light or a state of not emitting light on the basis of a threshold value defined in advance, with respect to multiple-value sub-pixel data, which are obtained from multiple-value image data to be displayed;

searching binary sub-pixel data having a light-emitting pattern defined in advance from said binary sub-pixel data;

correcting a light-emitting pattern of said multiple-value sub-pixel data corresponding to the searched binary sub-pixel data so that the contrast is improved where binary sub-pixel data having said light-emitting pattern defined in advance are searched in the searching step; and allocating multiple-value sub-pixel data to light-emitting elements corresponding thereto after the correcting step, and performing display with said display device.

14. The display method according to claim 13, wherein in said step of generating binary sub-pixel data, a state where light is emitted or a state where no light is emitted is determined, dependent upon a magnitude when multiple-value sub-pixel data corresponding to one sub-pixel are compared with said threshold value defined in advance, and binary sub-pixel data corresponding to said multiple-value sub-pixel data are generated.

15. The display method according to claim 13, wherein:

in the second searching step, said light-emitting pattern defined in advance is a pattern in which a sub-pixel of B of said three primary colors R, G and B aligned in said first direction emits light in isolation;

in said correcting step, taking note of multiple-value sub-pixel data corresponding to said sub-pixel of B that emits light in isolation, the noted multiple-value sub-pixel data are corrected to multiple-value sub-pixel data adjacent to one side thereof, and multiple-value sub-pixel data adjacent to the other side thereof are corrected to said multiple-value sub-pixel data.

16. The display method according to claim 15, wherein:

in said correcting step, said light-emitting pattern defined in advance is a pattern in which a sub-pixel of B of said three primary colors R, G and B aligned in said first direction emits light in isolation; and in said correcting step, taking note of multiple-value sub-pixel data corresponding to said sub-pixel of B that emits light in isolation, correcting multiple-value sub-pixel data adjacent to one side of said multiple-value sub-pixel data to said multiple-value sub-pixel data.

17. The display method according to claim 13, wherein:

in the correcting step, said light-emitting pattern defined in advance is a pattern in which a set composed of sub-pixels of B and R adjacent to each other of said three primary colors R, G and B aligned in said first direction emits light in isolation;

in the correcting step, taking note of multiple-value sub-pixel data corresponding to a sub-pixel of B and a sub-pixel of R, which constitute said set, correcting multiple-value sub-pixel data corresponding to one sub-pixel constituting said set to multiple-value sub-pixel data adjacent thereto, correcting multiple-value sub-pixel data corresponding to said other sub-pixel constituting said set to said one sub-pixel data constituting said set, correcting multiple-value sub-pixel data adjacent to said multiple-value sub-pixel data corresponding to said other sub-pixel constituting said set to said other sub-pixel data constituting said set.

18. A display apparatus comprising:

a display device;

said display device including sets of three light-emitting elements, which respectively emit light of the three primary colors of R, G, and B;

said three light-emitting elements are aligned in a fixed order to form one pixel;

said pixels are aligned in a first direction to form one line;

a plurality of such lines are aligned in a second direction, which is orthogonal to said first direction, to form a display screen;

a unit operable to correct a light-emitting pattern so that the contrast is improved where sub-pixel data having a light-emitting pattern defined in advance exists in sub-pixel data obtained from data of an image to be displayed, wherein said light-emitting pattern includes isolated sub-pixels making a small contribution to contrast;

a unit operable to allocate sub-pixel data to said light-emitting elements corresponding thereto after correction made by said correcting unit; and a unit operable to display corrected display data on said display device.

19. A display apparatus comprising:

a display device;

said display device including sets of three light-emitting elements, which respectively emit light of the three primary colors of R, G, and B;

said three light-emitting elements are aligned in a fixed order to form one pixel;

said pixels are aligned in a first direction to form one line;

a plurality of such lines are aligned in a second direction, which is orthogonal to said first direction, to form a display screen;

a two-times magnifying unit operable to search data of an image having a pattern, in which only one pixel positioned at a center of said pattern emits light, from three pixels adjacent to each other in said first direction among image data to be displayed, and to generate sub-pixel data by magnifying said image data to be displayed, by a factor of two in said first direction;

unit operable to search sub-pixel data having a light-emitting pattern defined in advance, from said sub-pixel data corresponding to said image data where image data having said pattern, in which only one pixel positioned at the center emits light, exist according to the result of search by said two-times magnifying unit, and correcting said light-emitting pattern, so that the contrast becomes high, where sub-pixel data having said light-emitting pattern defined in advance exist according to the result of said search; and unit operable to allocate said sub-pixel data to said light-emitting elements corresponding thereto after correction by said correcting unit and making said display device perform display.

20. A display apparatus comprising:

a display device, in which three light-emitting elements, which respectively emit light of the three primary colors of R, G, and B, are aligned in a fixed order to form one pixel, said pixels are aligned in a first direction to form one line, and a plurality of such lines are aligned in a second direction, which is orthogonal to said first direction, to form a display screen;

unit operable to generate binary sub-pixel data by determining a state of emitting light or a state of not emitting light on the basis of a threshold value defined in advance, with respect to sub-pixel data of multiple values, which are obtained from multiple-value image data to be displayed;

unit operable to search binary sub-pixel data having a light-emitting pattern defined in advance from said binary sub-pixel data and correcting a light-emitting pattern of said multiple-value sub-pixel data corresponding to said searched binary sub-pixel data so that the contrast becomes high; and unit operable to allocate multiple-value sub-pixel data to light-emitting elements corresponding thereto after said correction by said correcting unit, and making said display device perform display.

* * * * *

UNITED STATES PATENT AND TRADEMARK OFFICE

CERTIFICATE OF CORRECTION

PATENT NO. : 7,142,219 B2
APPLICATION NO. : 10/108297
DATED : November 28, 2006
INVENTOR(S) : Tadanori Tezuka et al.

It is certified that error appears in the above-identified patent and that said Letters Patent is hereby corrected as shown below:

Column 3; Line 13; After "unit" insert -- , --.

Column 20, Line 58; Delete "22(a)-22(c))" and insert -- 22(a)-22(c) --, therefor.

Column 25; Line 50-51; In Claim 7, after "data;" delete "and".

Column 27; Line 43; In Claim 16, delete "15," and insert -- 13, --, therefor.

Signed and Sealed this

Twenty-second Day of May, 2007

JON W. DUDAS
*Director of the United States Patent and Trademark Office*